US008955871B2

(12) United States Patent
Takamoto et al.

(10) Patent No.: US 8,955,871 B2
(45) Date of Patent: Feb. 17, 2015

(54) TRANSFER AND LOCOMOTION APPARATUS

(75) Inventors: Yoichi Takamoto, Kitakyushu (JP); Yuji Kawakubo, Kitakyushu (JP); Kenichi Miyamoto, Kitakyushu (JP); Katsuyuki Baba, Kitakyushu (JP); Shin-ichiro Takasugi, Fukuoka (JP); Ryuichi Kusaba, Fukuoka (JP); Yukihide Iwamoto, Fukuoka (JP)

(73) Assignee: TMSUK Co., Ltd., Fukuoka (JP)

( * ) Notice: Subject to any disclaimer, the term of this patent is extended or adjusted under 35 U.S.C. 154(b) by 13 days.

(21) Appl. No.: 13/375,432

(22) PCT Filed: May 31, 2010

(86) PCT No.: PCT/JP2010/059181

§ 371 (c)(1),
(2), (4) Date: Feb. 14, 2012

(87) PCT Pub. No.: WO2010/140560

PCT Pub. Date: Dec. 9, 2010

(65) Prior Publication Data

US 2012/0133113 A1 May 31, 2012

(30) Foreign Application Priority Data

Jun. 1, 2009 (JP) ..... 2009-132605

(51) Int. Cl.
*A61G 5/10* (2006.01)
*A61G 5/14* (2006.01)
(Continued)

(52) U.S. Cl.
CPC . *A61G 5/14* (2013.01); *A61G 5/042* (2013.01); *A61G 7/1007* (2013.01);
(Continued)

(58) Field of Classification Search
CPC ..... A61G 5/14; A61G 7/1007; A61G 7/1086; A61G 2200/34; A61G 2200/36; A61G 7/1038; A61G 7/1096; B62K 3/16
USPC ..... 280/657, 250, 250.1, 87.01; 180/65.1; 5/87.1
See application file for complete search history.

(56) References Cited

U.S. PATENT DOCUMENTS 3,137,869 A * 6/1964 Johnson ..... 5/86.1
3,493,245 A * 2/1970 Nabinger ..... 280/250
(Continued)

FOREIGN PATENT DOCUMENTS

CN 1517048 A 8/2004
JP 4303446 A 10/1992
(Continued)

OTHER PUBLICATIONS

Japanese Office Action issued in Japanese Patent Application No. 2011-518436 dated Feb. 25, 2014.
(Continued)

*Primary Examiner* — J. Allen Shriver, II
*Assistant Examiner* — Brian Cassidy
(74) *Attorney, Agent, or Firm* — Sughrue Mion, PLLC

(57) ABSTRACT

Disclosed is a transfer and locomotion apparatus with excellent functionality, stability, versatility, and user-friendliness such that a person requiring nursing care can transfer between the transfer and locomotion apparatus to a bed and a toilet seat, etc., keeping the orientation of the body. The apparatus comprises a base part having a driving part, a seat part provided on the base part and which a user can sit from a back portion or a side portion, and a breast pad part standing in a front end side of the seat part and contacting a breast of the user. At least one of the seat part and the breast pad part is held to be able to move forward and backward, and upward and downward with respect to the base part.

6 Claims, 10 Drawing Sheets

(51) Int. Cl.
*A61G 5/04* (2013.01)
*A61G 7/10* (2006.01)
*A61G 5/12* (2006.01)

(52) U.S. Cl.
CPC ..... *A61G 7/1048* (2013.01); *A61G 7/1086* (2013.01); *A61G 7/109* (2013.01); *A61G 2005/124* (2013.01); *A61G 2005/127* (2013.01); *A61G 2200/34* (2013.01); *A61G 2200/36* (2013.01); *A61G 2200/56* (2013.01)
USPC ..... 280/657

(56) References Cited

U.S. PATENT DOCUMENTS

| | | | | |
|---|---|---|---|---|
| 4,054,319 | A * | 10/1977 | Fogg et al. | 297/466 |
| 5,148,557 | A * | 9/1992 | Fridman et al. | 5/86.1 |
| 5,489,258 | A * | 2/1996 | Wohnsen et al. | 602/5 |
| 5,937,959 | A * | 8/1999 | Fujii et al. | 180/12 |
| 6,053,519 | A * | 4/2000 | Poindexter et al. | 280/250.1 |
| 6,270,101 | B1 * | 8/2001 | Hase | 280/250 |
| 6,308,981 | B1 * | 10/2001 | Proehl | 280/657 |
| 6,440,046 | B1 * | 8/2002 | Tholkes | 482/142 |
| 8,661,579 | B2 * | 3/2014 | Orrico et al. | 5/81.1 R |
| 8,832,874 | B2 * | 9/2014 | Alexander | 5/81.1 R |
| 2002/0027385 | A1 * | 3/2002 | Porcheron | 297/466 |
| 2006/0097557 | A1 * | 5/2006 | Tholkes et al. | 297/330 |
| 2007/0085405 | A1 * | 4/2007 | Grotner | 297/423.11 |
| 2010/0007180 | A1 * | 1/2010 | Ovre et al. | 297/68 |

FOREIGN PATENT DOCUMENTS

| | | | |
|---|---|---|---|
| JP | 5-85178 | B2 | 12/1993 |
| JP | 10-234792 | A | 9/1998 |
| JP | 2000-225155 | A | 8/2000 |
| JP | 2000-237240 | A | 9/2000 |
| JP | 2001-129032 | A | 5/2001 |
| JP | 2004-008464 | A | 1/2004 |
| JP | 2004-267619 | A | 9/2004 |
| JP | 3731001 | B2 | 10/2005 |
| JP | 2005-328950 | A | 12/2005 |
| JP | 3126399 | U | 10/2006 |
| JP | 2007-075566 | A | 3/2007 |
| JP | 2007-215636 | A | 8/2007 |
| JP | 2008-023273 | A | 2/2008 |
| WO | 9611658 | | 4/1996 |

OTHER PUBLICATIONS

Communication dated Oct. 9, 2014, issued by the European Patent Office in counterpart Application No. 10783343.6.

* cited by examiner

TRANSFER AND LOCOMOTION APPARATUS

TECHNICAL FIELD

The present invention relates to a general-purpose transfer and locomotion apparatus. The transfer and locomotion apparatus according to the present invention can be easily used to locomote by not only people having no disabilities, but also people requiring nursing care, such as old people getting weak legs and physically handicapped people. Even if used for a long period of time, the transfer and locomotion apparatus does not impose a strain on the back and the lumbar part of the user, and, particularly, even if the user has injured-spine, the transfer and locomotion apparatus can be used comfortably. Moreover, it is easy for the user to transfer from the transfer and locomotion apparatus to a bed, a toilet seat, a wheelchair and so forth.

BACKGROUND ART

Conventionally, a wheelchair has generally been used by a person who cannot walk even by using a stick due to the paralysis of the lower extremities. Such a person can locomote, operating this wheelchair him/herself, as substitute for the feet. The most popular wheelchair, as a standard, includes front small wheels and back large wheels attached to the chair. Here, small wheels are referred to as casters and can freely rotate. Meanwhile, large wheels are driving wheels and have driving rings (hand rims). The user rotates the driving rings him/herself to drive the wheelchair. To operate a wheelchair with complete control, it is necessary to practice sitting on the wheelchair in a balanced manner, as well as to practice getting on and off, and driving the wheelchair. It is difficult for a person who does not have the strong muscle of the upper extremity to improve the skill of operating a standard wheelchair. Besides this standard type, there are various types of wheelchairs, including: one having front large wheels which can be easily operated and therefore is suitable for old people; one being driven with one hand suitable for a person who can use only one hand; a manual chain-driven type for outdoor driving, and special types, such as a buggy type and an abdominal position driving type. In addition, there are a light, foldable and portable wheelchair which can be easily carried on an automobile, and an electric wheelchair which can be operated only by pushing a switch button suitable for a person who cannot use the hands.

However, a general wheelchair has a backrest in the back of a seat part. Therefore, the user should get on and off the wheelchair from the front side, and, in order to sit on the seat part, should standup once and turn around. Accordingly, the user often needs the help of a caretaker to transfer from a bed or a toilet seat to the wheelchair.

Particularly, to transfer a disabled person who requires nursing care, such as a bedridden person or an old person getting weak legs, from the bed and so forth to the wheelchair, the caretaker needs to get the disabled person around the caretaker's arm or uses a transferring device referred to as a lifter. When the caretaker gets the disabled person around the caretaker's arm to sustain the disabled person's weight, a significant burden is applied to the caretaker, and therefore the caretaker is likely to suffer from lumbar pain. In addition, a general wheelchair lacks usability, because there is a risk that the user loses the balance and falls down when getting on and off the wheelchair.

Moreover, with a general wheelchair, the backrest presses against the back of the user. In particular, a spine-injured patient who feels no pain due to the injured-spine cannot perceive physical pain, and therefore is likely to suffer from the blood circulation disorder. Furthermore, it is necessary for a spine-injured patient to take care a sitting posture. It is because a spine-injured patient poses such that the spine is bent backward and the pelvis is significantly tilted backward when sitting on the wheelchair. Therefore, a spine-injured patient tends to be pressed on a narrower portion of the body than a physically unimpaired person.

Meanwhile, in a case of using a lifter, it takes a lot of trouble to prepare for suspending a person requiring nursing care, and therefore the caretaker has a bigger burden. In addition to this, large space is required to place and accommodate the device. In particular, in a case of suspending the buttocks of a person requiring nursing care, there is a problem that the person requiring nursing care feels scared or uncomfortable. Meanwhile, in a case of supporting a person requiring nursing care under the arms, the caretaker needs to sustain the weight of the person requiring nursing care under the arms. As a result of this, there is a problem that the person requiring nursing care feels pain or uncomfortable.

In addition, a person requiring nursing care who is bedridden for a long period of time tends to reduce the muscles and prolong the hospital stay. To prevent these problems, it is necessary to regularly make the patient physically active with assistance or rehabilitation, and frequently change the body position, and therefore significant burdens may be applied to the caretaker.

Although a walker has been used, which can reduce the burdens of the caretaker and the person requiring nursing care and has an effect on rehabilitation, it does not have a seat part. Therefore, it is necessary to prepare for a separate chair in case the person requiring nursing care gets tired. In addition, since a wheel walker does not have a stopping device, it is not stable when the user stops. Accordingly, a wheel walker is not suitable for outdoor use or walking on a slope, that is, has limited uses and places, and lacks versatility.

In order to solve these problems, for example, Patent Literature 1 discloses "a caring chair having a transfer function provided with a cart conveyed where a cared person is made to sit on a seat."

In addition, Patent Literature 2 discloses "a body transfer apparatus for nursing having a table and a chair provided on a hollow shaft fitted to a main pole standing in a pedestal with casters, and a lifting and lowering device to lift and lower the table and the chair along the main pole."

CITATION LIST

Patent Literature

PTL 1: Japanese Patent Application Laid-Open Publication No. 2000-237240

PTL 2: Japanese Patent Application Laid-Open Publication No. 2000-225155

SUMMARY OF INVENTION

Technical Problem

However, the above-mentioned conventional techniques have the following problems.

(1) (Patent Literature 1)

The caring chair having a transfer function has a backrest in the back part of a seat like general chairs, and therefore, has a problems that there are many steps to transfer the person requiring nursing care, and consequently lacks usability. To be more specific, in order to transfer the person requiring nursing care, there are following steps of: reclining the backrest until the backrest is parallel to the seat or removing the backrest in advance; moving the seat onto the bed; adjusting the height of the seat to the height of the bed; placing the person requiring nursing care on the seat; raising the seat; and finally, pulling out the entire caring chair having a transfer function from the bed.

In addition, there is another problem that the backrest presses against the back in use, and therefore the caring chair is not suitable for a spine-injured person.

(2) (Patent Literature 2)

The body transfer apparatus for nursing has a configuration where a chair can open in both directions around the shaft provided in the center of the back part. In order to place the person requiring nursing care in the seat, his/her back contacts the chair opening, and the caretaker should insert the seat in the buttocks of the person requiring nursing care, alternately lifting the left and right thighs of the user. Therefore, the body transfer apparatus for nursing has a problem that the caretaker has a lot of troubles. Also, there is a problem of lack of usability and mass productivity because of the complexity of the structure of the chair.

Moreover, there is another problem that the strength is not sufficient because the seat is divided into the left side and the right side, and therefore it is difficult to securely support the weight of the person requiring nursing care. That is, there is a problem of lack of durability and stability of sustaining the weight.

In view of the above-described problems, an object of the present invention is to provide a transfer and locomotion apparatus with improved functionality, stability, versatility and user-friendliness. The transfer and locomotion apparatus according to the present invention has the following advantages: the user can easily transfer between the transfer and locomotion apparatus to a bed, a toilet seat, and a wheelchair, keeping the orientation of the body; it is possible to provide a simple structure to allow the user to use the transfer and locomotion apparatus alone; it is possible to use the transfer and locomotion apparatus for a long period of time without applying the strain on the back and the lumbar part of the user; in particular, even if the user has injured-spine and so forth, it is possible to use the transfer and locomotion apparatus comfortably; it is possible to significantly reduce the burdens on the caretaker and the person requiring nursing care (hereinafter referred to as the user); and not only old people and physically-handicapped persons, but also physically unimpaired children and adults can easily use the transfer and locomotion apparatus as substitute for a bicycle, a motorcycle, a wheelchair and so forth to locomote for a long distance.

Solution to Problem

To solve the above-described conventional problems, the transfer and locomotion apparatus according to the present invention has the following configuration.

The transfer and locomotion apparatus recited in a first aspect of the present invention includes: a base part having a driving part; a seat part provided on the base part, a user sitting on the seat part from a back portion or a side portion of the base part; and a breast pad part standing in a front end side of the seat part and contacting a breast of the user. At least one of the seat part and the breast pad part is held to be able to move forward and backward or upward and downward, with respect to the base part.

By this configuration, it is possible to produce the following effects.

(1) There is no backrest in the seat part; the user can get on and off the seat part from the rear portion or a side of the base part; for transfer, there is no need to take apart or deform the seat part; in particular, when the user requires nursing care and gets weak legs, the user can easily straddle and sit on the seat part from the rear portion of the base part, keeping the orientation of the body in a state the user sits on a bed or a toilet seat; the user can do transfer action alone without the help of the caretaker; the base part can sustain the user's weight; the transfer and locomotion apparatus is not likely to fall down; and it is possible to significantly reduce the burdens of the caretaker and the user. In this way, it is possible to save labor and improve usability.

(2) The breast pad part is provided, which stands in the front end side of the seat part and contacts the breast of the user; the user hags the breast pad part in a forward bending posture to apply the user's weight to the breast pad part; by this means, it is possible to share the user's weight between the seat part and the breast pad part to reliably support the body of the user; even if the seat part does not have a backrest, the user can maintain a sitting posture or a standing posture, and locomote in a stable posture for a long period of time; it is possible to reduce the strain on the user's back and lumbar part, and therefore improve reliability and usability.

(3) The breast pad part contacts the breast of the user; by this means, it is possible to maintain a correct posture similar to a normal standing posture such that the spine bends into S-shape, bending forward at the cervical spine, bending backward at the thoracic spine and bending forward at the lumbar spine and the pelvis slightly tilts forward. Also it is possible to maintain an ideal sitting posture where the user's weight is evenly dispersed over the ischial tuberosity and reduce the burden on the user, and therefore improve usability during continuous use for a long period of time.

(4) At least one of the seat part and the breast pad part is held to be able to move forward and backward or upward and downward with respect to the base part; by this means, it is possible to freely adjust the positions of the seat part and the breast pad part depending on the height of a target to which the user transfer (hereinafter referred to as "transfer target"), such as abed and a toilet seat, the physique and the posture of the user; it is possible to bring the seat part close to the transfer target, and therefore the user can easily do transfer action alone; it is possible to use the transfer and locomotion apparatus even if there is no accommodation space to insert the base part in the lower part of the transfer target, and therefore improve versatility.

(5) It is possible to move the seat part and the breast pad part forward and backward or upward and downward; by this means, the user can safely and easily get on and off the seat part by moving the seat part and the breast pad part backward and downward with respect to the base part; it is possible to hold the user in a desired posture (at a desired angle) or raise to a desired level by moving the seat part and the breast pad part forward and upward after getting on the seat part; and the user can locomote in a comfortable posture, and therefore it is possible to improve usability.

(6) There is no backrest in the seat part, and therefore, the back of the user (the back of the seat part) is exposed to outside; therefore, the user having injured back or lumber, more specifically, a patient having injured spine or lumber spine can easily have examination directly from the back surface (back); it is not necessary to transfer to a bed and so forth, and therefore, it is possible to reduce the burden on the user; and also it is possible to reduce the period of time required for medical examination, and therefore improve convenience in medical examination.

(7) The base part has the driving part, and therefore various users, not only old people and physically-handicapped persons but also physically unimpaired children and adults, can easily use the transfer and locomotion apparatus as substitute for a bicycle, a motorcycle and a wheelchair to locomote indoors and outdoors.

(8) When the seat part is moved upward, the user can locomote (drive) in a posture similar to a standing position; by this means, the user can acquire a wider view than a conventional wheelchair; also the user can easily be viewed by other persons to prevent an accident such as a crash, and therefore it is possible to improve safety; it is possible to prevent blood flow from reducing; the transfer and locomotion apparatus can be used instead of a wheelchair, for long-range locomotion; and, in this way, it is possible to improve usability.

(9) It is possible to move the seat part and the breast pad part upward, and also move the breast pad part forward; by this means, the user can reach for positions for which conventional wheelchairs cannot reach; also, the user can take goods in and out from a high place, open and close a door, wash the face and do cooking; and in this way, it is possible to expand the user's activities, and therefore improve functionality.

(10) By moving the seat part forward and backward, or upward and downward using electric driving means and so forth, it is possible to exercise the user's hip joints, knee joints, ankle joints and so forth; therefore, the user can do rehabilitation by bending forward him/herself to expand the region in which joints of the lower body can move, build up muscles and improve blood flow; and by this means, it is possible to prevent decrease in motor ability of the lower body, edema and so forth. In this way, it is possible to improve functionality and save labor.

Here, although any configuration of the base part is possible, it is preferable to set the dimensions of the front, back, left and right of the base part to prevent the user from losing the balance and falling down when the user in the apparatus moves the seat part and the breast pad part forward and backward or upward and downward. Here, the upper surface of the base part on which the user's feet are placed, is a flat surface without unevenness not to restrain the movement of the feet when the user do transfer action. By this means, it is possible to improve usability.

The driving part is not limited to the configuration having wheels as long as it is possible to move (drive) the base part, and the driving part may have a crawler or leg parts for multilegged walking. When the driving part has wheels, it is possible to select the number and arrangement appropriately. When the driving part has two front wheels and two back wheels, it is possible to reliably sustain the user's weight and freely move the transfer and locomotion apparatus indoors and outdoors, and therefore improve the stability for weight bearing and movement. The base part may have a power unit, and, in this case, it is preferable to use a motor with forward and reverse rotation. Although it is desired that at least either the front wheels or the rear wheels are driving wheels, four-wheel drive is possible. The driving wheels are not limited as long as it is possible to move the main body of the transfer and locomotion apparatus by operating an accelerator and so forth provided in a given position in the transfer and locomotion apparatus. In particular, when the base part can move in all directions, it is possible to provide the transfer and locomotion apparatus with an ability to turn in a small radius, and therefore improve mobility.

Here, it is possible to provide a battery in the base part, as a power source. In case the transfer and locomotion apparatus cannot drive due to shortage of the battery capacity, it is preferable to design the transfer and locomotion apparatus to be able to move by pushing by the hands of the caretaker with clutch operation. In a case in which driving wheels are provided in the front of the base part with a power unit and a power source, when the seat part moves to the back portion and the lower portion of the base part while the user sits on the seat part, and therefore the center of gravity moves to the back portion of the base part, these can serve as weights to stabilize the base part horizontally. Here, by making difference in rotating speed between the right and left driving wheels, it is possible to turn left and right. Also it is possible to change the radius of gyration using the ratio between the different rotating speeds of the left and right driving wheels. In particular, the rotating directions of the left driving wheel and the right driving wheel can be individually controlled, and in this case, one is rotated in the forward direction and the other is rotated in the reverse direction, so that it is possible to revolve on the spot. In this way, it is possible to improve the mobility. Another configuration is possible where the front wheels and the rear wheel are formed in the same size, and a steering mechanism may be provided, like a car and a motorcycle. The reason is to improve driving performance and operationality outdoors.

As a battery, it is preferable to use a secondary battery, which is chargeable, such as a nickel-cadmium battery, a nickel-metal hydride battery, a lithium-ion secondary battery and a lead battery. In addition, in a case where a battery is removably mounted, while the used battery is removed from the transfer and locomotion apparatus and charged, another charged battery can be mounted to drive the transfer and locomotion apparatus. In this way, it is possible to improve usability. In the transfer and locomotion apparatus, a spare battery can be mounted in the base part, so that it is possible to increase the travel distance.

For a brake, a configuration is possible where a wire is connected to a brake lever and the wire is pulled to press a brake pad against the rims of the driving wheels, and an electro-magnetic brake is possible. A brake lever may be provided in a given position convenient for the user. In particular, by providing the brake lever nearby one of the left side or the right side of the breast pad part, it is possible to apply the brake to fix the base part even at the time of transfer, and therefore improve safety.

With the present embodiment, it is possible to select a given type of wheels, it is preferable to use punctureless tires containing urethane foam, because there is no need to worry about puncture and adjust gas-pressure, and therefore improve usability. Moreover, a suspension is provided for each driving wheel to make a comfortable ride.

Here, foot guards in a reticular pattern with metal pipes, are provided in front of or aside of the base part, so that the user can participate in a competition such as a soccer match in a standing posture.

Although the seat part supports the buttocks of the user and may be designed in any shape, it is preferable to form to have a steeple head such that the portion from the tip to the neighborhood of the center gradually widens and the portion from the center to the rear portion increasingly widens. By this means, the seat part does not restrain the movement of the user at the time of transfer and the movement of thighs when the seat part is raised and the user takes a standing posture. In this way, it is possible to improve usability.

In order to easily transfer to and from the transfer and locomotion apparatus by making the buttocks slippery on the surface of the seat part, the surface of the seat part may be covered with leather, or fabric made of materials such as polyurethane fiber and aramid fiber, which have a low friction coefficient, or may be provided with a number of rollers on the surface of the seat part. Here, by inserting foam made of high molecular compound such as urethane between the base made of metal or synthetic resin and the surface of the seat part, it is possible to absorb vibrations and shocks and disperse the pressure on the position under the ischium to which a high pressure is applied. By this means, it is possible to prevent compression of nerve, improve blood flow, and reduce pain of the buttocks. Moreover, for the purpose of preventing the buttocks from being sticky with perspiration, an air hole may be provided on the seat part, or the surface may be made of cloth having a mesh structure.

For the breast pad part, although it is possible to select a given shape, it is preferable to select the area, the shape and the hardness to avoid from partly pressing the breast of the user and from bringing discomfort. It is preferable to insert foam (cushion) made of high molecular compound such as urethane between the base made of metal or synthetic resin and the surface. In addition, for the purpose of preventing the breast from being sticky with perspiration, an air hole may be provided in the breast pad part, or the surface of the breast pad part may be made of cloth having a mesh structure in the same way as for the seat part.

Here, a display part to display the remaining battery level may be provided on the upper surface of the breast pad part. The user can look at this display when the user gets in the transfer and locomotion apparatus. It is possible to display the remaining battery level by changing the color or the lighting state of a lamp, so that the user can go out, feeling relieved.

The seat part and the breast pad part may be moved manually or electrically. Provided with an electrical drive mechanism part, it is possible to move the seat part and the breast pad part to desired positions with simple operation, and therefore improve operationality and save labor. Here, the seat part and the breast pad part may be integrally or individually move forward and backward or upward and downward. For example, as a method of moving the seat part and the breast pad part forward and backward, and upward and downward, rotation with a four-link mechanism may be used. As methods of moving the seat part and the breast pad part upward and downward, elevating means such as a combination of a rack and a pinion, a link mechanism of a lazy tong, a hydraulic or gas-pressure cylinder, and a ball screw and so forth may be used. In addition, elevating means may be arranged diagonally to perform forward and backward movement and upward and downward movement at the same time.

Here, when the seat part is moved to the same level as in the transfer target, the seat part and the base part are arranged such that the rear end of the seat part approximately matches the rear end of the base part, or projects more backward than the rear end of the base part. By this means, the seat part can approach the transfer target such as a toilet seat so as not to form a gap between the seat part and the transfer target. As a result of this, it is possible to easily do transfer action.

Here, the transfer and locomotion apparatus can be driven by remote control, using a mobile communication apparatus such as a cellular phone or wireless LAN. In this case, sitting on a bed and so forth, the user moves the transfer and locomotion apparatus which is apart from the user (the user cannot reach for the apparatus) by remote control using such as a joy stick. By this means, the user can position the transfer and locomotion apparatus on the optimal transfer position and transfer from the bed to the transfer and locomotion apparatus without the help of the caretaker. Therefore, it is possible to reduce the burden on the caretaker.

The invention recited in a second aspect is the transfer and locomotion apparatus according to the first aspect, and includes a drive mechanism part configured to move the seat part between a back and lower position and a front and upper position with respect to the base part to move the seat part forward and backward, and upward and downward.

By this configuration, it is possible to produce the following effects, in addition to the effects of the first aspect.

(1) The drive mechanism part is provided to move the seat part forward and backward, and upward and downward by moving the seat part between a back and lower position and a front and upper position with respect to the base part. By this means, it is possible to readily move the seat part to the optimum position for transfer, getting on and off and locomotion (driving) in a single action, and therefore save labor and improve usability.

(2) When the seat part is moved between a back and lower position and a front and upper position with respect to the base part, it is possible to support the user's body by applying the user's weight to the breast pad part in front of the user; by this means, it is possible to move the seat part forward and backward, and upward and downward in safety without losing the balance; it is possible to prevent the user from falling off the seat part or falling down, so that everyone can easily use the transfer and locomotion apparatus, feeling relieved; In this way, it is possible to improve the stability and reliability of operation.

(3) The seat part is moved by the drive mechanism part; by this means, it is possible to easily adjust the height of center of gravity (position) depending on the moving (driving) speed and the physique of the user, and maintain a stable posture; therefore, it is possible to improve the safety during driving and the stability of posture.

Here, preferably, the drive mechanism part may include elevating means such as a combination of a rack and a pinion, a link mechanism of a lazy tong, a hydraulic or gas-pressure cylinder, and a ball screw and so forth, as described above. By arranging the above-described drive mechanism part diagonally from a rear and lower position to a front and upper position with respect to the base part, it is possible to move the seat part forward and backward, and upward and downward at the same time.

The invention recited in a third aspect is the transfer and locomotion apparatus according to the first aspect, and includes a drive mechanism part configured to pivotably rotate one of the seat part and the breast pad part around a horizontal axis orthogonal to a forward and backward direction of the base part to move one of the seat part and the breast pad part forward and backward, and upward and downward.

By this configuration, it is possible to produce the following effects, in addition to the effects of the first aspect.

(1) The drive mechanism part is provided to move the seat part or the breast pad part forward and backward, and upward and downward, by rotating the seat part or the breast pad part around a horizontal axis orthogonal to the forward and backward direction of the base part. By this means, it is possible to lift and move the user with a small force, and therefore save labor and improve compactness.

(2) The drive mechanism part pivotably rotates the seat part and the breast pad part; by this means, in order to transfer the user, it is possible to lower the seat part and the breast pad part while these are tilted backward; also it is possible to lift the seat part and the breast pad part while these are tilted forward; and therefore, it is possible to hold the user in a desired posture (angle) with smooth operation and lift to a desired level, and consequently improve the stability of operation.

Although, the drive mechanism part is not limited as long as it can pivotably rotate the seat part and the breast pad part to move forward and backward, and upward and downward, it is preferable to use a four-link mechanism and so forth. The reason is to reduce the size of the drive mechanism and save labor.

The invention recited in a fourth aspect is the transfer and locomotion apparatus according to the third aspect and includes the drive mechanism part. The drive mechanism part has; a first coupling pivot shaft and a second coupling pivot shaft provided in the base part on two front and back positions; a third coupling pivot shaft and a fourth coupling pivot shaft provided below the seat part on two front and back positions; a front link part having one or more link shafts configured to connect between the first coupling pivot shaft and the third coupling pivot shaft; a back link part having one or more link shafts configured to connect between the second coupling pivot shaft and the fourth coupling pivot shaft; and a link driving part configured to expand and contract, the link driving part having both ends pivotably coupled to the front link part and the back link part, respectively.

By this configuration, it is possible to produce the following effects, in addition to the effects of the third aspect.

(1) The drive mechanism part has a first coupling pivot shaft and a second coupling pivot shaft provided in the base part at two front and back positions and a third coupling pivot shaft and a fourth coupling pivot shaft provided below the seat part at two front and back positions. The first coupling pivot shaft and the third coupling pivot shaft are connected by the front link part having one or more link shafts, and the second coupling pivot shaft and the fourth coupling pivot shaft are connected by the rear link part having one or more link shafts. The link driving part which has both ends pivotably coupled with the front link part and the back link part is expanded and contracted; by this means, the angle between the upper surface of the base part and the front and back link parts varies while the distance between the first and second coupling pivot shafts and the distance between the third and fourth coupling pivot shafts are fixed; by this means, it is possible to move the seat part placed above the third and fourth coupling pivot shafts upward and downward, pivotably rotating the seat part forward and backward; as compared to a configuration in which a direct acting type of hydraulic or gas-pressure cylinder directly move the seat part upward and downward, it is possible to adjust the height of the seat part in a wider range with a smaller stroke; and therefore, it is possible to reduce the size and weight of the drive mechanism part.

(2) The seat part is supported by the front link part and the back link part at two, front and rear positions, and therefore, it is possible to reliably sustain the user's weight. By this means, occurrence of rocking during locomotion can be reduced, and therefore it is possible to improve the stability of the posture.

Here, although the seat part is provided above the third and fourth coupling pivot shafts of the drive mechanism part (the upper end side of the moving parts), the arrangement is not limited to this, but the pivot shaft holding part to pivotably hold the third and fourth coupling pivot shafts may be formed under and integrally with the seat part, or the seat part may be removably attached to the pivot shaft holding part.

Moreover, also the breast pad part may be integrally formed with the seat part and pivotably rotated or moved upward and downward at the same time, or may be pivotably rotated or moved upward and downward, separately from the seat part.

The front link part connects between the first coupling pivot shaft and the third coupling pivot shaft by at least one link shaft, meanwhile the back link part connects between the second coupling pivot shaft and the fourth coupling pivot shaft by at least one link shaft. Here, it is preferable to adopt a configuration where two, left and right points of each coupling pivot shaft are connected by two link shafts. By this means, it is possible to sustain the user's weight with four-link shafts, and therefore improve the stability, durability and safety for supporting the user.

Here, as the link driving part, it is preferable to adopt an expanding and contracting means such as a hydraulic or gas-pressure cylinder and so forth. The reason is to move heavy load with a compact design and to provide easy control and smooth operation without noise.

The invention recited in a fifth aspect is the transfer and locomotion apparatus according to the fourth aspect. At least one of the seat part and the breast pad part is slidably provided on a strut, the strut standing on one of the third coupling pivot shaft and a pivot shaft holding part configured to pivotably hold the third coupling pivot shaft and the fourth coupling pivot shaft.

By this configuration, it is possible to produce the following effect, in addition to the effects of the fourth aspect.

(1) At least one of the seat part and the breast pad part is slidably provided on a strut. The strut stands on the third coupling pivot shaft or the pivot shaft holding part that pivotably holds the third coupling pivot shaft and the fourth coupling pivot shaft; by this means, it is possible to broaden the range in which the seat part and the breast pad part can move by moving the seat part and the breast pad part upward and downward, depending on the physique of the user and so forth; and therefore, it is possible to improve versatility.

Here, an inserting slot to insert the strut, may be provided in the seat part or the breast pad part, and the inserted strut is cramped with a screw or fitted with a pin. By this means, it is possible to fix the seat part and the breast pad part in desired positions.

In addition, when standing on the third coupling pivot shaft, the strut can pivotably rotate with the third coupling pivot shaft. By this means, it is possible to freely adjust the angles of the breast pad part and the seat part provided on the strut. In this case, a ratcheting mechanism is provided in the lower end part of the strut (around the third coupling pivot shaft), so that it is possible to fix the strut at a desired angle. The breast pad part and the seat part are pivotably rotated around the pivot shaft, and therefore it is possible to adjust the angles of inclination of the breast pad part and the seat part depending on the physique and preference of the user. As a result of this, the user can use the transfer and locomotion apparatus in a comfortable posture.

Here, in addition, a sitting detection part such as a pressure-sensitive sensor and a warning means may be provided. The sitting detection part detects the user sitting on the seat part, and the warning means presents a warning with sound or light when the sitting detection part detects that the user has sat on the seat part over a predetermined period of time. When the warning means presents a warning, the seat part and the breast pad part is tilted forward and the upper body of the user leans on the breast pad part, and then the seat part having supported the buttocks of the user is tilted backward to leave the buttocks. By this means, it is possible to prevent blood circulation disorder of the buttocks. In addition, a position sensor that detects the position of the seat part heightwise is provided, and, when the position sensor detects that the user has sat on the seat part for a long period of time, the seat part is raised to take the user in approximately a standing posture. By this means, it is also possible to prevent blood circulation disorder of the buttocks.

The strut serves as a support to which the user's weight is applied during a forward bending posture, and therefore preferably stands in the front end side of the seat part, and in the center part of the seat part in the width direction. When the strut is provided to pivotably rotate in the forward and backward direction of the base part and provided coaxially with the coupling shafts of the drive mechanism, it is possible to simplify the structure.

Here, when a switch button to turn on and off the power unit and change the upward and downward movement of the seat part is provided on the front surface (the front side of the base part) of the breast pad part, it is possible to prevent sudden movement at the time of transfer, and therefore improve safety.

When grippers are provided in at least one side or the front part of the breast pad part to pivotably rotate in the horizontal plane, the user can pull the transfer and locomotion apparatus toward the his/her body, or pull away the transfer and locomotion apparatus from the his/her body by holding the grippers with his/her hands to easily adjust the position. Therefore, it is possible to improve usability. In addition, when the seat part and the breast pad part are pivotably rotated, the user can reliably hold his/her body by holding the grippers with his/her hands, and therefore it is possible to improve safety. Moreover, the grippers pivotably rotate in the horizontal plane; by this means, the grippers are pivotably rotated forward after getting on the seat part to prevent the grippers from restraining the posture of user; the breast pad part can reliably sustain the user's weight when the user is in a forward bending posture, and therefore it is possible to improve the stability and reliability of supporting; it is possible to adapt to two actions for transfer and locomotion only by pivotably rotating the grippers, and therefore improve versatility; and it is possible to reduce the number of parts, and therefore improve mass productivity.

The grippers may be formed by pipes made of metal or synthetic resin. In addition, although the form of the grippers may be selected appropriately, it is preferable to adopt a U-shape or an inverted U-shape because of ease of gripping. By inserting one end of each gripper in an insert part formed in the breast pad part, the gripper can pivotably rotate. The inserted grippers are cramped with screws or fitted with pins with respect to the insert part. By this means, it is possible to adjust the height of the grippers depending on the physique and the posture of the user, the application and so forth.

In addition, a switch, levers and so forth may be attached to the grippers to drive the transfer and locomotion apparatus, and control the upward and downward movement and the rotation of the seat part.

The invention recited in a six aspect is the transfer and locomotion apparatus according to one of the first to the fifth aspects and includes a leg protecting part configured to protect at least part of legs of the user, the leg protecting part being provided in one of a front portion and a side portion of the base part.

By this configuration, it is possible to produce the following effect, in addition to the effect of one of the first to the fifth aspect.

(1) The leg protecting part is provided in the front side or a side in the base part to protect at least part of the legs of the user. By this means, it is possible to protect the knees, shins, and calves, and therefore improve safety.

Here, it is possible to appropriately select the shape of the leg protecting part. For example, a plate type, fence type, and grid type of frame may be set up in the front side and both sides of the base part to surround the user. Alternatively, the leg protecting part may directly hold to prevent the legs of the user from moving horizontally or forward and backward. When holding the legs of the user, the leg protecting part can sustain part of the user's weight, with the breast pad part and the seat part, and therefore the user's weight can be sustained by sharing the weight among them. By this means, it is possible to stably maintain the posture of the user even if the user is approximately standing, and therefore improve usability. In this case, as the leg protecting part, it is preferable to have two knee pad parts each having a horizontal section as an approximately semicircular or U-shape to hold the front surface and both sides of each leg. In particular, in order to softly support the part below each knee (the upper end of tibia) of the user, it is preferable to form the knee pad parts or the overall leg protecting part with elastic member such as urethane, or partly coat the contact surface of the knee pad parts with elastic body.

The auxiliary frames with casters may be provided in both sides of the base part to be able to move forward and backward in parallel to the longitudinal direction of the base part. In this case, the auxiliary frames are moved forward and backward depending on the posture (the position of the center of gravity) of the user. By this means, it is possible to maintain the balance to prevent the base part from falling down, and therefore improve safety. When the transfer and locomotion apparatus is not used, the auxiliary frames with casters are moved to overlap both sides of the base part. By this means, it is possible to reduce the overall length of the transfer and locomotion apparatus to be stored in a small space, and therefore improve portability and save space.

In a sitting posture when the seat part is tilted backward or lowered, there is the center of gravity in the rear portion of the base part, and therefore the auxiliary frames with casters are moved backward to prevent the overall transfer and locomotion apparatus from falling down backward. Moreover, in a standing (erecting) posture or a forward bending posture when the seat part is tilted forward or raised, the center of gravity shifts to the front side of the base part. Therefore, the auxiliary frames with casters are moved forward to balance the center of gravity, so that it is possible to prevent the overall transfer and locomotion apparatus from falling down forward.

The configuration of the auxiliary frames with casters is not limited as long as the auxiliary frames with casters can move forward and backward with respect to the base part. For example, it is preferable to form long holes in both sides of the base part, parallel to the longitudinal direction, and the left and right auxiliary frames with casters provided in both sides of the base part are connected via a coupling shaft penetrating the long holes.

Hand rails may be provided on the upper surfaces of both sides of the base part, or respective upper surfaces of the auxiliary frames with casters. By this means, the user can do transfer action along the hand rails at the time of transfer. In addition, it is possible to protect the user during locomotion, and therefore improve safety.

The invention recited in a seventh aspect is the transfer and locomotion apparatus according to one of the first to the sixth aspects, and includes a waist pad part pivotably held in a back end side of the seat part.

By this configuration, it is possible to produce the following effects, in addition to the effects of one of the first to the sixth aspects.

(1) The waist pad part is provided, which is pivotably held in the rear end side of the seat part; by this means, when the user gets on or off (transfers) the seat part, the waist pad part is reclined in the horizontal direction to prevent the waist pad part from restraining the transfer action of the user; when the user sits on the seat part and drives, the waist pad part stands in the vertical direction, and therefore can support the buttocks and the lumbar part of the user, and reliably prevent the user from falling off the seat part at the time of start or acceleration; and in this way, it is possible to improve usability and safety.

(2) When the seat part is moved backward and downward to transfer the user to the transfer target such as a bed and a toilet seat, a gap may be created between the seat part and the transfer target because it is not possible to satisfactorily bring the seat part close to the transfer target, or a step may be created between the seat part and the transfer target because it is not possible to adjust the height of the seat part to that of the transfer target. To solve these problems, the waist pad part is reclined backward to clear the gap and step. By this means, it is possible to accomplish smooth transfer action of the user between the seat part and the transfer target, and therefore improve usability and versatility.

Here, the configuration of the waist pad part is not limited as long as the waist pad part pivotably rotates around the horizontal axis orthogonal to the forward and backward direction of the base part. Pivotably rotating operation may be manually or electrically performed. When pivotably rotating operation is electrically performed, it is possible to pivotably rotate the waist pad part with a desired angle with simple operation, and therefore improve operationality and save labor. In addition, the waist pad part may be pivotably rotated in conjunction with the seat part moving forward and backward, upward and downward, or pivotably rotating. When the seat part is moved backward or downward, the waist pad part may be automatically reclined in the horizontal direction. By this means, it is possible to perform transfer action smoothly without considering the waist pad part. Meanwhile, when the seat part is moved forward or upward, the waist pad part may automatically stand in the vertical direction. By this means, the waist pad part can safely support the user and there is no need of troublesome operation. In this way, it is possible to improve usability and safety.

The invention recited in an eighth aspect is the transfer and locomotion apparatus according to one of the first to the seventh aspects, and includes a footrest part provided on the base part to slidably move forward and backward.

By this configuration, it is possible to produce the following effects, in addition to the effects of one of the first to the seventh aspects.

(1) The footrest part is provided on the base part to slidably move forward and backward. By this means, when the seat part is moved forward and backward, the user can move his/her whole body forward and backward while placing the feet on the footrest part. Therefore, there is no need to lift the feet or move the feet forward and backward him/herself, so that it is possible to improve the stability of the center of gravity and usability.

(2) When the seat part is moved backward to transfer the user to the transfer target such as a bed and a toilet seat, it is possible to bring the footrest part close to the transfer target. By this means, it is possible to accomplish transfer action by smoothly shifting the weight, and therefore improve usability.

Here, the configuration of the footrest part is not limited as long as the footrest part can slidably move on the base part forward and backward. It is preferable to adopt a configuration where concave rails or grooves are formed or provided to guide the footrest part on the upper surface or in both left and right sides of the base part, parallel to the forward and backward direction of the base part. Wheels or rollers are provided on the bottom surface or in both left and right sides of the footrest part, and therefore it is possible to slidably move the footrest part smoothly. The footrest part can be moved in conjunction with the forward and backward movement of the body of the user, only by placing the feet on the footrest part to apply the weight to the footrest part. More preferably, the footrest part moves forward and backward in conjunction with the seat part, and therefore it is possible to improve the stability of operation, and usability.

Here, the footrest parts are not necessarily placed horizontally, but may be inclined so as to lower the back portion. The reason is that when the user moves backward, the footrest part is lowered, so that the user can easily get in and off the transfer and locomotion apparatus. Moreover, when the footrest part moves upward and downward in conjunction with the seat part, it is possible to keep the distance between the seat part and the footrest part constant. Therefore, it is possible to consistently support the feet of the user independent of the height of the seat part, and consequently improve safety and usability.

Advantageous Effects of Invention

As described above, the transfer and locomotion apparatus according to the present invention can provide the following advantages.

The invention recited in the first aspect provides the following advantage.

(1) It is possible to provide a transfer and locomotion apparatus without back support to save labor and improve usability and safety. With the transfer and locomotion apparatus according to the present invention: the user can easily straddle and sit on the seat part from the back portion of the base part, keeping the orientation of the body in a state the user sits on a bed or a toilet seat; the user can do transfer action him/herself without the help of the caretaker; the transfer and locomotion apparatus is not likely to fall down; the seat part and the breast pad part are pivotably rotated forward, and therefore the user can hug the breast pad part in a forward bending posture to apply the user's weight to the breast pad part; the user's weight is shared between the seat part and the breast pad part to reliably sustain the user's body; the user can be in a sitting posture or a standing posture and can locomote for a long period of time; and it is possible to significantly reduce the burdens of the caretaker and the user.

The invention recited in the second aspect provides the following advantage, in addition to the advantage of the first aspect.

(1) It is possible to provide the transfer and locomotion apparatus to improve stability and reliability of operation. With the transfer and locomotion apparatus according to the present invention: while supporting the user by applying the user's weight to the breast pad part in front of the user, it is possible to move the seat part between the a back and lower position and front and upward position with respect to the base part in safety without losing the balance; and the user is not likely to fall off the seat part or fall down; and everyone can easily use the transfer and locomotion apparatus, feeling relieved.

The invention recited in the third aspect provides the following advantage, in addition to the advantage of the first aspect.

(1) It is possible to provide the transfer and locomotion apparatus to improve compactness and save labor. The seat part or the breast pad part is pivotably rotated around the horizontal axis to move forward and backward, and upward and downward. By this means, it is possible to lift and move the user with a small force.

The invention recited in the fourth aspect provides the following advantage, in addition to the advantage of the third aspect.

(1) It is possible to provide the transfer and locomotion apparatus in small size and light weight to improve the efficiency of drive, and compactness. The front link part and the back link part are pivotably rotated from a state where they are folded to be approximately parallel to the upper surface of the base part to a state they stand at approximately 90 degrees. By this means, it is possible to adjust the height of the seat part in a wide range.

The invention recited in the fifth aspect provides the following advantage, in addition to the advantage of the second aspect.

(1) It is possible to provide the transfer and locomotion apparatus to improve versatility. The seat part and the breast pad part are moved upward and downward along the strut. By this means, it is possible to expand the range in which the seat part and breast pad part can move to adapt to various body types of users.

The invention recited in the sixth aspect provides the following advantage, in addition to the advantages of one of the first to the fifth aspects.

(1) It is possible to provide the transfer and locomotion apparatus to improve safety, which can reliably protect the knees, shins, and calves of the user.

The invention recited in the seventh aspect provides the following advantage, in addition to the advantages of one of the first to the sixth aspects.

(1) It is possible to provide the transfer and locomotion apparatus to improve usability and safety. The waist pad part is pivotably rotated to the optimum position (with the optimum angle) according to the position of the seat part. By this means, it is possible to smoothly get on and off the seat part during transfer. Also, it is possible to reliably support the buttocks and the lumbar part of the user during locomotion (driving).

The invention recited in the eighth aspect provides the following advantage, in addition to the advantages of one of the first to the seventh aspects.

(1) It is possible to provide the transfer and locomotion apparatus to improve the stability of the center of gravity and usability. When the seat part is moved forward and backward, the user can move the whole body forward and backward while placing the feet on the footrest part; the user does not need to lift his/her feet or move the feet forward and backward him/herself; and by this means, it is possible to smoothly do transfer action.

DESCRIPTION OF EMBODIMENTS

Now, the transfer and locomotion apparatus according to embodiments of the present invention will be described with reference to the drawings.

Embodiment 1

Figure 1:
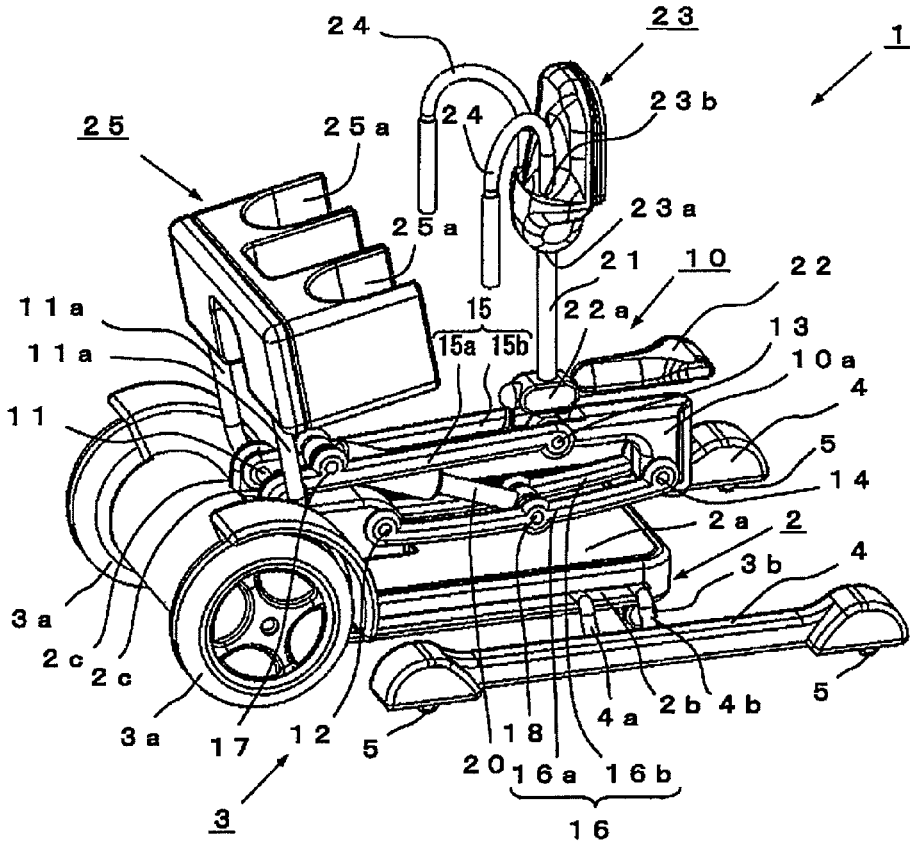
FIG. 1 is a perspective view schematically showing a state in which a seat part of a transfer and locomotion apparatus according to Embodiment 1 is lowered.
Figure 2:
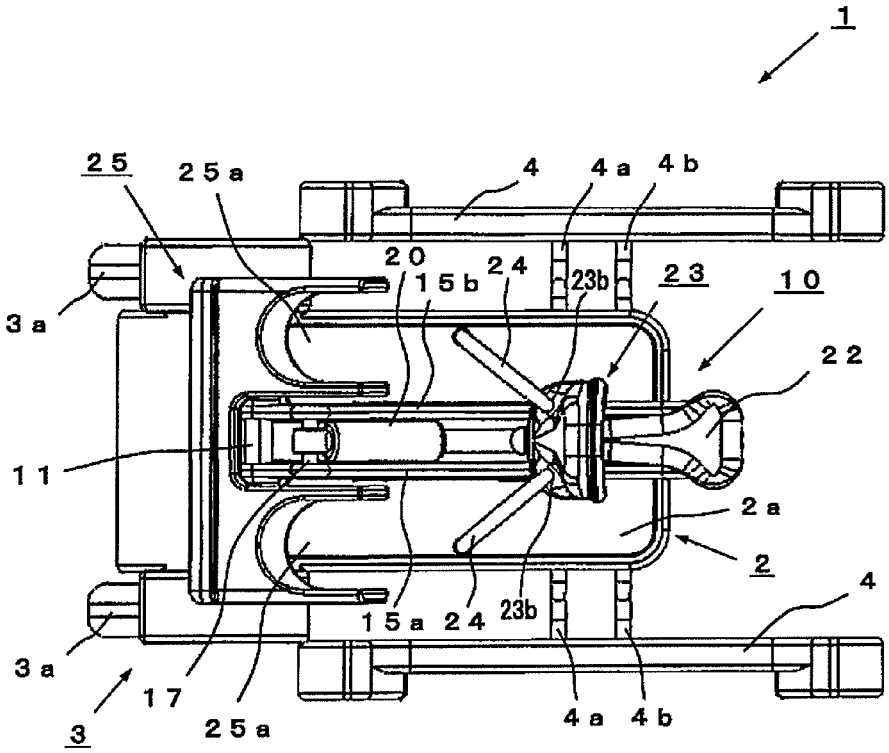
FIG. 2 is a plan view schematically showing a state in which the seat part of the transfer and locomotion apparatus according to Embodiment 1 is lowered.
Figure 3:
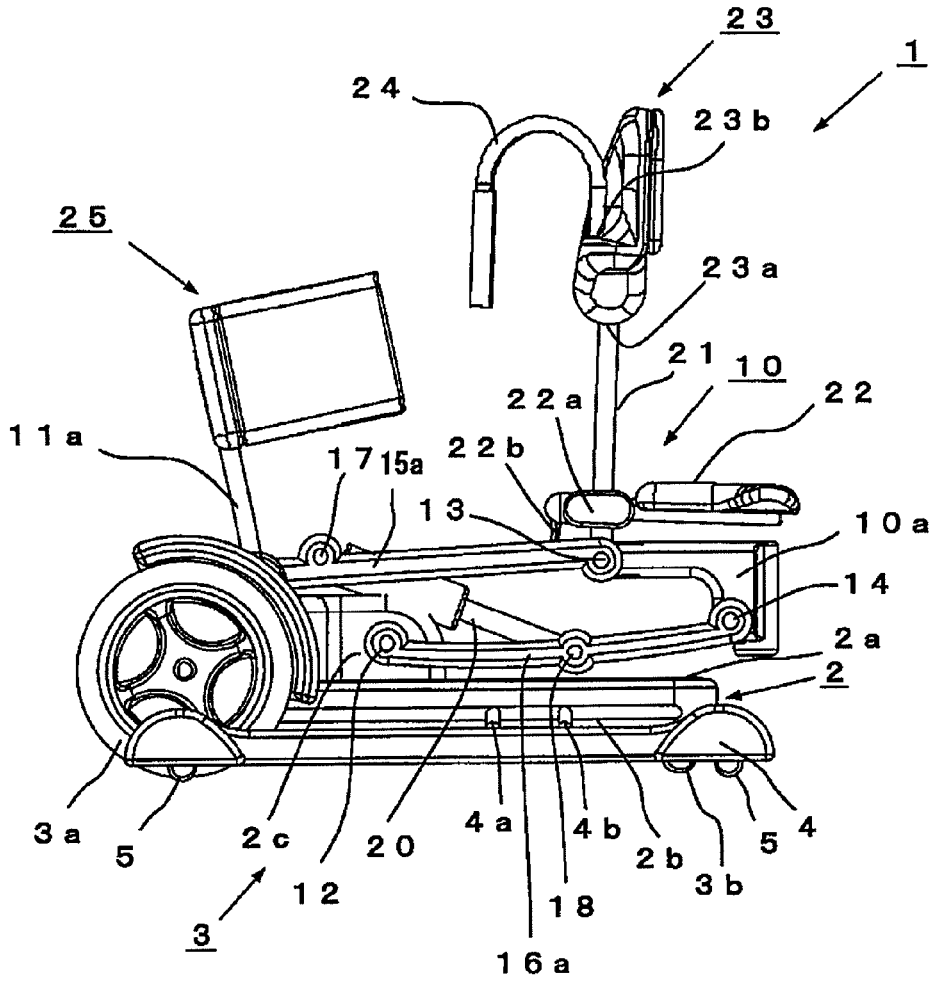
FIG. 3 is a side view schematically showing a state in which the seat part of the transfer and locomotion apparatus according to Embodiment 1 is lowered.

FIG. 1 is a perspective view schematically showing a state in which a seat part of a transfer and locomotion apparatus according to Embodiment 1 is lowered. FIG. 2 is a plan view schematically showing a state in which the seat part of the transfer and locomotion apparatus according to Embodiment 1 is lowered. FIG. 3 is a side view schematically showing a state in which the seat part of the transfer and locomotion apparatus according to Embodiment 1 is lowered.

In FIG. 1 to FIG. 3, reference numeral 1 denotes a transfer and locomotion apparatus according to Embodiment 1 of the present invention, 2 denotes a base part of the transfer and locomotion apparatus 1 parallel to the ground, 2*a* denotes an upper surface of the base part 2, 2*b* denotes a guide slit opening on both side surfaces of the base part 2, 2*c* denotes left and right pivot shaft holding plates standing on the front portion of the base part 2, 3 denotes a driving part for the base part 2, which has driving wheels 3*a* and rear wheels 3*b* described later, 3*a* denotes the driving wheels provided in the left and right sides of the front portion of the base part 2, which serve as front wheels of the driving part 3, 3*b* denotes the rear wheels of the driving part 3, which are provided in the left and right sides of the back portion of the base part 2 (see FIG. 3), 4 denotes an auxiliary frames with casters provided in both sides of the base part 2, which can move forward and backward, 4*a* and 4*b* denote coupling shafts which penetrate through the elongate guide slit 2*b* opening on both side surfaces of the base part 2 and which connect the left and right auxiliary frames with casters 4 to one another at the front and back positions, respectively, 5 denotes casters each two provided on the bottom of an auxiliary frame 4 at the front and back positions, 10 denotes a drive mechanism part of the transfer and locomotion apparatus 1 which pivotably rotates a seat part 22 and a breast pad part 23 described later to move forward and backward, and upward and downward, 11 and 12 denote first and second coupling pivot shafts which are pivotably held by the left and right pivot shaft holding plates 2*c* standing on the front portion of the base part 2, 13 and 14 denote third and fourth coupling pivot shafts which are pivotably held by a pivot shaft holding part 10*a* provided below the seat part 22 at the two front and back portions of the pivot shaft holding part 10*a*, 15 denotes a front link part which couples the first coupling pivot shaft 11 with the third coupling pivot shaft 13 through two, left and right link shafts 15*a* and 15*b*, 16 denotes a back link part which couples the second coupling pivot shaft 12 with the fourth coupling pivot shaft 14 through two, left and right link shafts 16*a* and 16*b*, 17 denotes a front coupling shaft which couples the left and right link shafts 15*a* and 15*b* of the front link part 15 at a position on the way of the longitudinal direction (see FIG. 2), 18 denotes a back coupling shaft which couples the left and right link shafts 16*a* and 16*b* of the back link part 16 at a position on the way of the longitudinal direction, 20 denotes a link driving part of the drive mechanism part 10 which is configured to expand and contract and has both ends pivotably coupled to the front link part 15 and the back link part 16 through the front coupling shaft 17 and the back coupling shaft 18, 21 denotes a strut standing on the third coupling pivot shaft 13, 22 denotes the seat part of the transfer and locomotion apparatus 1 provided above the pivot shaft holding part 10*a*, 22*a* denotes an insert part in the seat part 22 into which the strut 21 is slidably inserted, 22*b* denotes a fixing operation part which fixes the insert part 22*a* in the seat part 22 to the strut 21 with screw cramp, 23 denotes a breast pad part of the transfer and locomotion apparatus 1, which has a fitting hole provided on the lower end into which the tip of the strut 21 is fitted, 23*a* denotes an insert hole through which the upper end of the strut 21 is fixedly inserted, being provided in the lower end of the center portion of the breast pad part 23, denotes inversed U-shaped grippers, each having one end inserted in one of engaging holes 23*b* formed on the front surface side of the breast pad part 23 at two left and right positions, and being pivotably held in the horizontal plane, 25 denotes a leg protecting part which is fitted into bending parts 11*a* formed by bending both end portions of the first coupling pivot shaft 11, and 25*a* denotes two knee pad parts of the leg protecting part 25 having an approximately semicircular arc or approximately U-shaped horizontal section to hold the knees, shins, and calves of the user.

Figure 4:
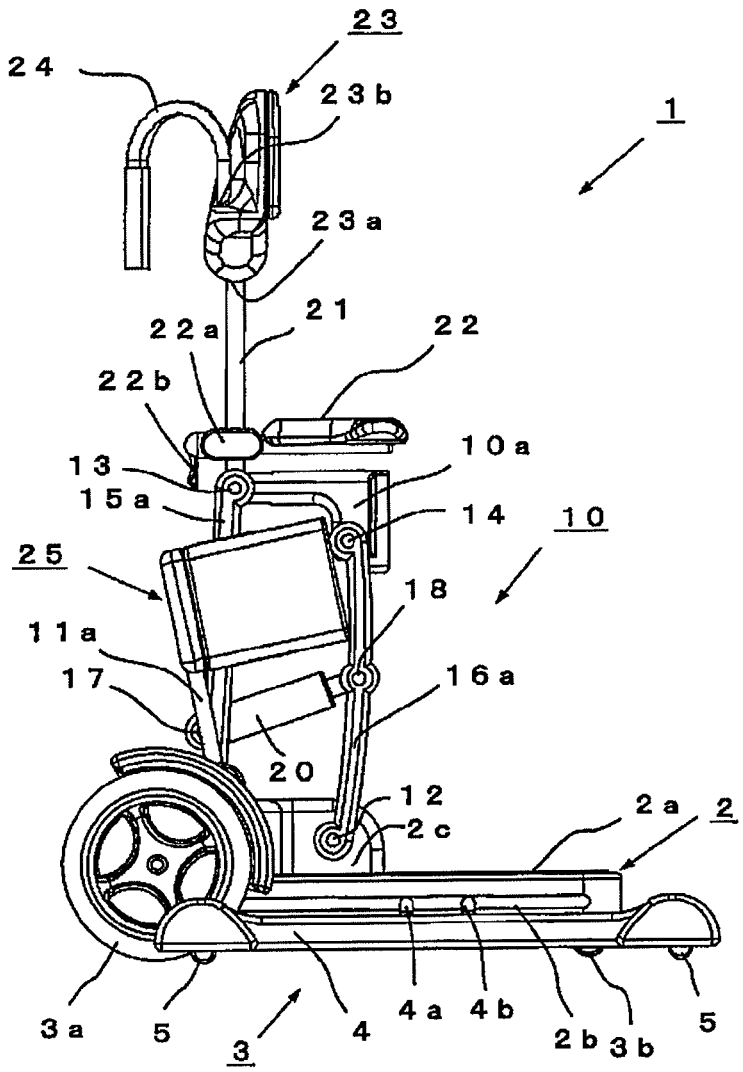
FIG. 4 is a side view schematically showing a state in which the seat part of the transfer and locomotion apparatus according to Embodiment 1 is raised.

FIG. 4 is a side view schematically showing a state in which the seat part of the transfer and locomotion apparatus according to Embodiment 1 is raised.

With the present embodiment, a four-link mechanism is adopted for the drive mechanism part 10 where the first coupling pivot shaft 11 and the second coupling pivot shaft 12 in the base part 2 are coupled with the third coupling pivot shaft 13 and the fourth coupling pivot shaft 14 provided below the seat part 22 via the front link part 15 and the back link part 16, respectively.

In the state shown in FIG. 3, the link driving part 20 is driven by an operation switch or lever (not shown) of the drive mechanism part 10, which is provided in a convenient position for the user. By this means, the front link part 15 and the back link part 16 pivotably rotate together around the first and second coupling pivot shafts 11 and 12 as reducing the length of the link driving part 20, and change from the state where the front link part 15 and the back link part 16 are approximately parallel to the upper surface 2*a* of the base part 2, to the state shown in FIG. 4 where they are approximately vertical to the upper surface 2*a* of the base part 2. As a result of this, the seat part 22 and the breast pad part 23 provided on the strut 21 standing on the third coupling pivot shaft 13 can move to the level for a standing posture shown in FIG. 4 while keeping the posture (for transfer) shown in FIG. 3.

At this time, in order to adapt to the change in the position of the center of gravity due to the rotation and rising of the seat part 22 and the breast pad part 23, the coupling shafts 4*a* and 4*b* are moved to the front side of the base part 2 along the guide slit 2*b* opening on both side surfaces of the base part 2. By this means, it is possible to keep balance by the auxiliary frames with casters 4 to prevent the transfer and locomotion apparatus 1 from falling forward.

The base part 2 is stable because of having two driving wheels 3*a* as the front wheels and two rear wheels 3*b* for the driving part 3. The driving wheels 3*a* as the front wheels allow the user to easily imagine the traveling direction of the transfer and locomotion apparatus 1, and therefore improve operationality. In addition, it is possible to easily ride over a step and so forth by increasing the diameter of each driving wheel 3*a* as a front wheel of the driving part 3, and therefore improve driving performance. Here, the size of the back wheels 3*b* of the driving part 3 may be the same as that of the driving wheels 3*a*. Moreover, the upper surface 2*a* of the base part 2 on which the feet of the user are placed, is wider than the shoulder length of the user, and is a plane to prevent the upper surface 2*a* from restraining the movement of the feet during transfer. By this means, it is possible to improve usability.

With the present embodiment, motors with forward and reverse rotation are adopted, as power units for the driving wheels 3*a*. Moreover, each driving wheel 3*a* includes one motor to be able to individually control the rotating speed and direction. The reason is that the transfer and locomotion apparatus can turn to the left or the right based on the difference in rotating speed between the left and right driving wheels 3*a* or revolve to the left or the right on the spot based on the difference in rotation direction between the left and right driving wheels 3*a*, and therefore it is possible to improve mobility. Here, it is possible to control the rotating speed and the rotation direction of the driving wheels 3*a* with accelerator bars or brake levers (nor shown) provided on the grippers 24, a switch provided on the breast pad part 23 (not shown) and so forth.

A battery serving as a power unit or a power source, is provided in the front portion of the base part 2, in addition to the driving wheels 3*a*. By this means, when the seat part 22 is lowered or tilted backward while the user sits on the seat part 22, and therefore the center of gravity moves to the back portion of the base part 2, the driving wheels 3*a* and the battery can serve as weights to stabilize the base part 2 horizontally. Here, the battery is removable, and therefore can be removed from the transfer and locomotion apparatus 1 to be charged. In addition, a battery gauge may be provided on the upper surface of the breast pad part 23 to allow the user to visually check the battery capacity with ease, and therefore it is possible to improve usability.

Here, the configuration of the driving part 3 is not limited to the present embodiment as long as it is possible to move (drive) the base part 2. For example, the driving part 3 may include a crawler, or leg parts for multilegged walking.

When the drive mechanism part 10 lowers the seat part 22 to the same level as of a transfer target such as a bed and a toilet seat, the rear end of the seat part 22 approximately matches the rear end of the base part 2 or projects more backward than the rear end of the base part 2. By this means, the seat part 22 can approach the transfer target without inserting the back portion of the base part 2 in the lower part of the transfer target, and therefore the user can easily and smoothly transfer to the transfer target. In this way, it is possible to improve versatility and usability. By using a hydraulic or gas-pressure cylinder as the link driving part 20, it is possible to move a heavy load with a compact design to provide easy control and smooth operation without noise.

As shown in FIG. 2 in an overhead view, the seat part 22 is shaped to have a steeple head such that the portion from the tip to the neighborhood of the center gradually widens and the portion from the center to the rear portion increasingly widens, like a bicycle saddle. Therefore, the seat part 22 neither restrains the movement for transfer nor restrains the movement of the thighs when the seat part 22 is raised and the user takes a standing posture. Here, the shape of the seat part 22 is not limited to this, but it is possible to select any shape to allow the user to easily straddle the seat part 22. For example, the shape of the seat part 22 may be as a gourd or a saddle for horse riding.

Here, with the present embodiment, the insert part 22*a* of the seat part 22 is inserted in the strut 21 standing on the third coupling pivot shaft 13 and the seat part 22 is slidably mounted by a fixing operation part 22*b* with screw cramp. Alternatively, the seat part 22 may be fixed on the upper surface of the pivot shaft holding part 10*a*. In addition, the strut 21 may be integrally formed with the pivot shaft holding part 10*a*.

The breast pad part 23 is formed with a flexible and elastic material so as not to partly press the user's breast or bring discomfort to the user's breast. Here, for the material and shape of the breast pad part 23, the dimension, the shape and the hardness may be appropriately selected depending on the physique and so forth of the user.

Each grippers 24 is formed with metal or synthetic resin pipes as an inverse U-shape, and one end of the gripper 24 is inserted in the engaging hole 23*b* of the breast pad part 23 to fix the rotation angle in the horizontal direction. By this means, the grippers 24 can be pivotably rotated on the horizontal plane if necessary, and moved to the sides or the front of the breast pad part 23 where the user can easily grips the gripper 24. Here, a rubber grip is attached to the end of each gripper 24 as antislip, and therefore the user pressing his/her breast against the breast pad part 23 can securely grip the ends of the grippers 24 and maintain a comfortable posture.

The lower end portion of the leg protecting part 25 is fitted into the bending parts 11*a* formed by bending both ends of the first coupling pivot shaft 11. By this means, the leg protecting part 25 can pivotably rotate with the first coupling pivot shaft 11. In addition, leg protecting part 25 is provided with two knee pad parts 25*a* each having an approximately semicircular arc or approximately U-shaped horizontal section and opening backward. By this means, it is possible to protect the front surface and both side surfaces of the portions under the knees (the upper ends of the tibias) of the user. In addition, it is possible to sustain part of the user's weight and hold the legs so as not to move the legs in the lateral direction and the forward and backward direction. Therefore, it is possible to stably maintain a standing posture and a forward bending posture, and in particular, protect the knees to reduce the strain of the knees. By this means, it is possible to improve usability. Here, when an elastic member such as urethane foam is inserted between the base and the surface of each knee pad part 25*a*, it is possible to reduce vibrations, shocks and the pressure on nerve during locomotion of the transfer and locomotion apparatus 1.

The shape of the leg protecting part 25 is not limited to the present embodiment, but a configuration is possible where a plate type, fence type, and grid type of frame may be set up in the front side and both sides of the base part 2 to surround the user.

Next, how to use the transfer and locomotion apparatus 1 will be described, for a case in which the user transfers from a transfer target to the transfer and locomotion apparatus according to Embodiment 1.

Figure 5:
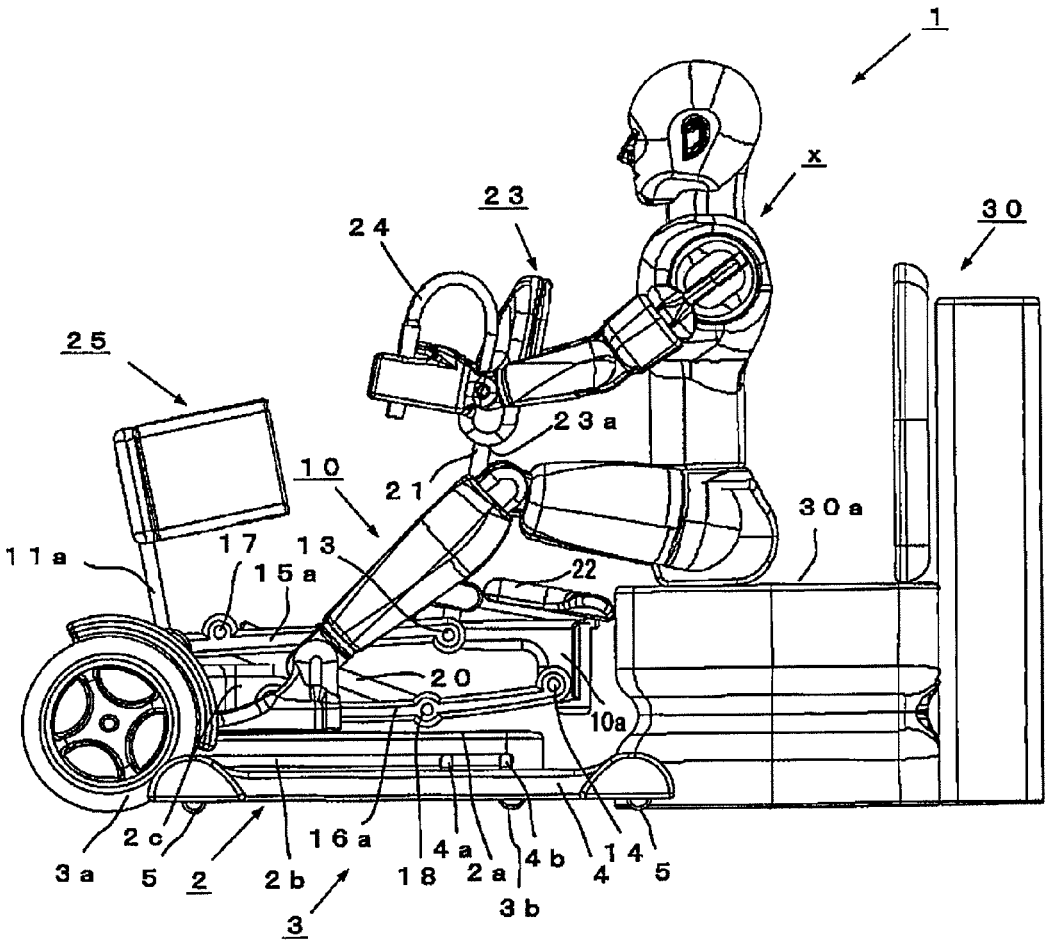
FIG. 5 is a side view schematically showing a state before a user transfers from a toilet seat using the transfer and locomotion apparatus according to Embodiment 1.
Figure 6:
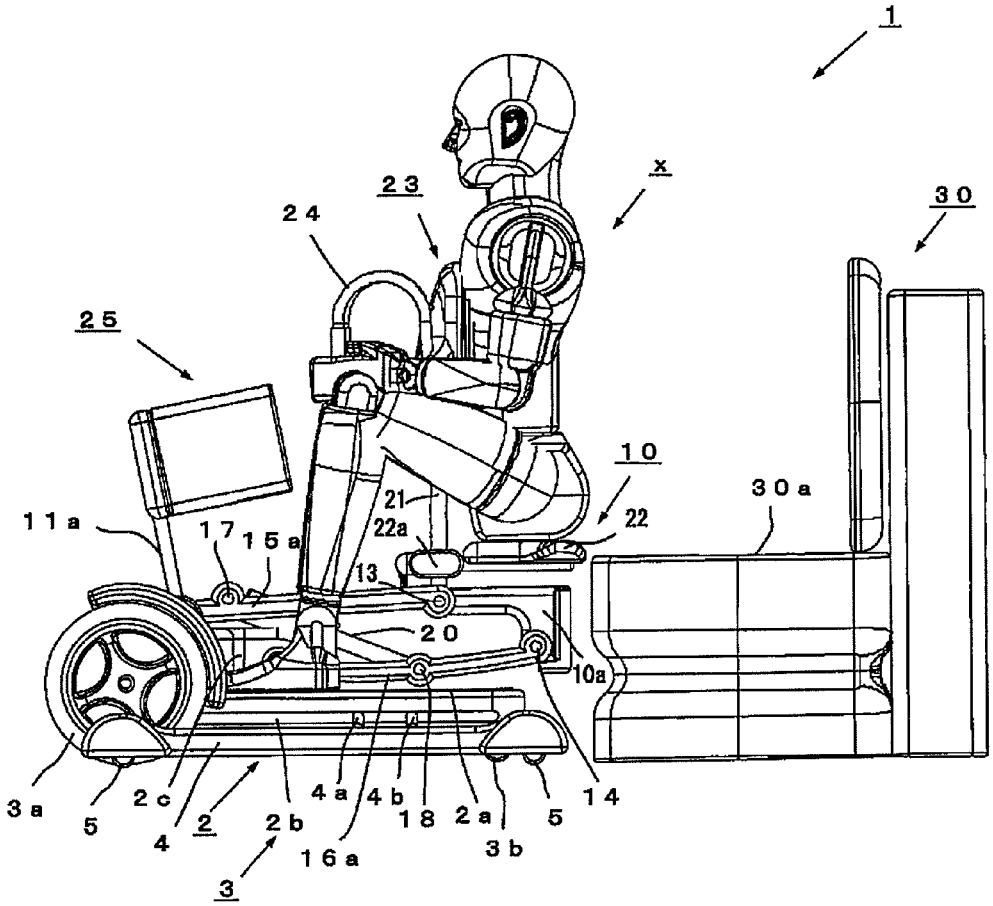
FIG. 6 is a side view schematically showing a state after the user transfers from the toilet seat using the transfer and locomotion apparatus according to Embodiment 1.

FIG. 5 is a side view schematically showing a state before the user transfers from a toilet seat using the transfer and locomotion apparatus according to Embodiment 1. FIG. 6 is a side view schematically showing a state after the user transfers from the toilet seat using the transfer and locomotion apparatus according to Embodiment 1.

In FIG. 5 and FIG. 6, reference numeral 30 denotes a toilet having a toilet seat 30*a* which is a transfer target, and X denotes a user.

In FIG. 5, the user X grips the grippers 24 with both hands while sitting on the toilet seat 30*a*, draws the transfer and locomotion apparatus 1 to him/her until the rear end of the seat part 22 of the transfer and locomotion apparatus 1 contacts the toilet seat 30*a* to position the transfer and locomotion apparatus 1 appropriately, and places both feet on the upper surface 2*a* of the base part 2. At this time, by pivotably rotating the grippers 24 toward the user (the back side of the base part 2) if necessary, the user can securely grip the grippers 24.

Here, the link driving part 20 of the drive mechanism part 10 may be extended in advance to lower the seat part 22 to the same level as the toilet seat 30*a* on which the user X sits, and therefore the user x can easily transfer from the toilet seat 30*a* to the seat part 22. In addition, the auxiliary frames with casters 4 may be moved backward with respect to the base part 2 to improve the stability during the transfer of the user x. Here, the coupling shafts 4*a* and 4*b* of the auxiliary frames with casters 4 are connected to the second coupling pivot shaft 12 of the drive mechanism part 10 via a link mechanism such as a gear or a belt, and therefore move forward and backward in conjunction with the rotation of the second coupling pivot shaft 12.

Next, as shown in FIG. 6, while gripping the grippers 24 so as to draw the breast pad part 23 to the breast of the user X, the user X moves the buttocks forward to sit on the seat part 22, and moves both legs forward, and consequently the user can gets on the transfer and locomotion apparatus 1 in a sitting posture.

Here, although, with the present embodiment, a case has been explained where the user transfers from the toilet seat 30*a* of the toilet 30 to the transfer and locomotion apparatus 1, the transfer target is not limited to this. The transfer and locomotion apparatus 1 is applicable to other transfer targets such as a bed and a wheelchair. In addition, when the user transfers from the transfer and locomotion apparatus 1 to a transfer target such as a bed and the toilet seat 30*a*, the procedure may be performed in the reverse order of the above-described procedure.

Next, how to use the transfer and locomotion apparatus according to Embodiment 1 will be described for a case of a standing posture.

Figure 7:
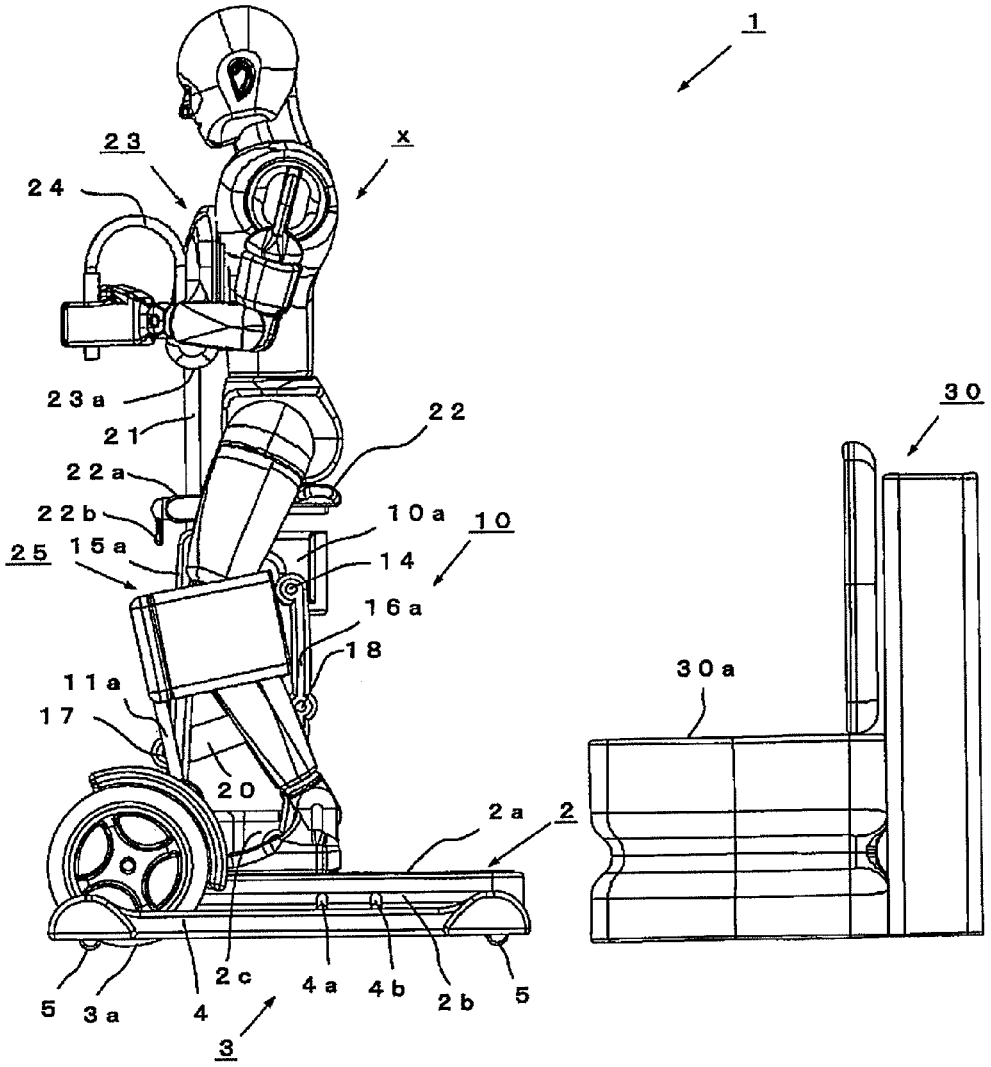
FIG. 7 is a side view schematically showing a state in which the user gets on the transfer and locomotion apparatus according to Embodiment 1 in a standing posture.

FIG. 7 is a side view schematically showing a state in which the user changes the posture from a sitting posture to a standing posture in the transfer and locomotion apparatus according to Embodiment 1.

When the user X in the state shown in FIG. 6 drives the drive mechanism part 10 by operating a control lever and so forth (not shown), the seat part 22 and the breast pad part 23 rise, pivotably rotating forward to change the posture of the user X to a standing posture as shown in FIG. 7. At this time, in order to balance the weight on the base part 2, the auxiliary frames with casters 4 moves forward with respect to the base part 2 by means of the above-described link mechanism, in conjunction with the rotation of the second coupling pivot shaft 12.

Here, it is preferable to adjust the height of the seat part 22 to the extent that the knees gently bend in order to sustain the user X's weight by sharing the weight among the seat part 22, the breast pad part 23 and leg protecting part 25. In addition, it is preferable to adjust the angle of the leg protecting part 25 with a ratcheting mechanism or screw cramp to hold the legs of the user X such that the portions below the knees contact the knee pad parts 25*a*.

The user X can locomote by releasing the brake of the transfer and locomotion apparatus 1 and operating an accelerator bar and so forth.

Next, how to use the transfer and locomotion apparatus according to Embodiment 1 will be described, for a case of a forward bending posture.

Figure 8:
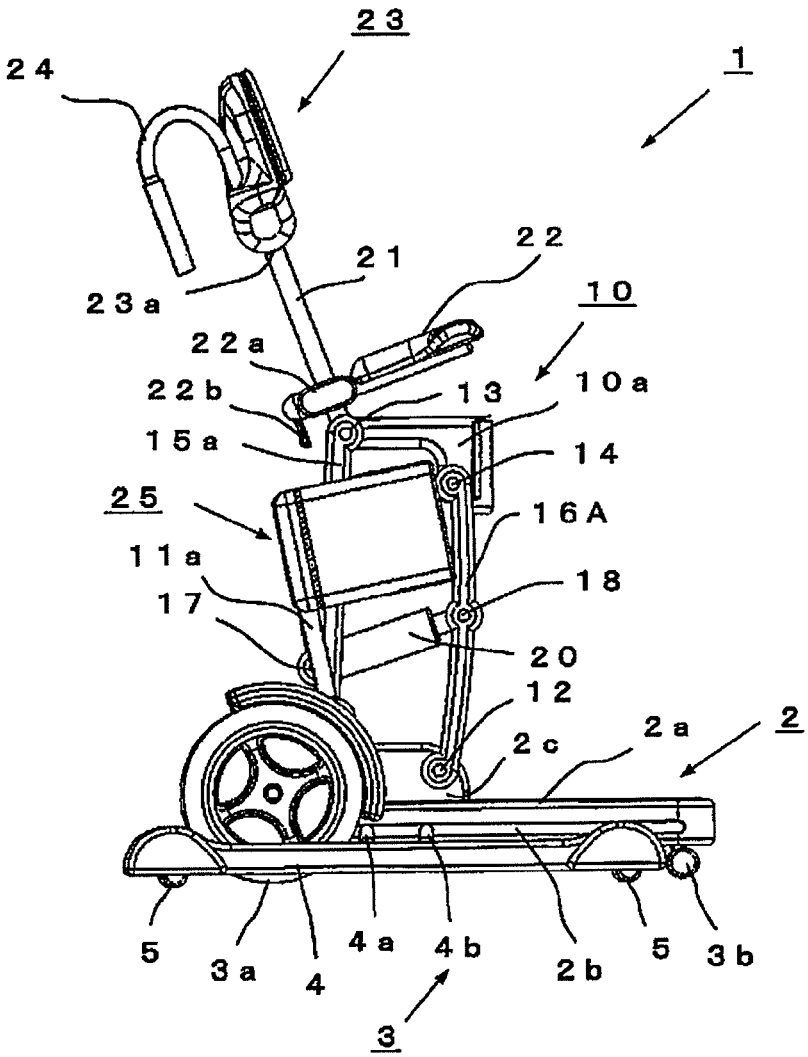
FIG. 8 is a side view schematically showing a state in which the seat part of the transfer and locomotion apparatus according to Embodiment 1 is tilted forward.

FIG. 8 is a side view schematically showing the transfer and locomotion apparatus according to Embodiment 1 in a forward bending posture.

In FIG. 8, the strut 21 is fixed to pivotably rotate around the third coupling pivot shaft 13 using a ratcheting mechanism, screw cramp and so forth, and the seat part 22 and breast pad part 23 are tilted forward. By this means, it is possible to apply the user X's weight to the breast pad part 23. In particular, it is possible to significantly reduce the strain on the user X who has injured spine, and sit for a long period of time in a comfortable posture. In this way, it is possible to improve usability and versatility. Here, the angle of the seat part 22 may be adjusted and fixed by providing a link mechanism or a piston cylinder between the pivot shaft holding part 10*a* and the bottom of the seat part 22.

The transfer and locomotion apparatus according to Embodiment 1 has the above-described configuration. By this means, it is possible to produce the following effects.

(1) There is no backrest in the seat part; the user can get on and off the seat part from the rear portion or a side of the base part; for transfer, there is no need to take apart or deform the seat part; in particular, when the user requires nursing care and gets weak legs, the user can easily straddle and sit on the seat part from the rear portion of the base part, keeping the orientation of the body in a state the user sits on a bed or a toilet seat; the user can do transfer action him/herself without the help of the caretaker; the base part can sustain the user's weight; the transfer and locomotion apparatus is not likely to fall down; and it is possible to significantly reduce the burdens of the caretaker and the user. In this way, it is possible to save labor and improve usability.

(2) The breast pad part is provided, which stands in the front end side of the seat part and contacts the breast of the user. By this means, the user hags the breast pad part in a forward bending posture to apply the user's weight to the breast pad part, and therefore the user's weight is shared between the seat part and the breast pad part to reliably sustain the user's body. In addition, even if there is no backrest, the user can stably maintain a sitting posture or a standing posture and locomote in a stable posture for a long period of time. Therefore, it is possible to reduce the strain on the back and the lumbar part of the user and improve safety and usability.

(3) The breast pad part contacts the breast of the user. By this means, it is possible to maintain a correct posture similar to a normal standing posture such that the spine bends into S-shape, bending forward at the cervical spine, bending backward at the thoracic spine and bending forward at the lumbar spine and the pelvis slightly tilts forward. Also it is possible to maintain an ideal sitting posture where the weight is evenly dispersed over the ischial tuberosity, and therefore reduce the strain on the user. In this way, it is possible to improve usability during continuous use for a long period of time.

(4) The drive mechanism part is provided to pivotably rotate the seat part and the breast pad part around the horizontal axis orthogonal to the forward and backward direction of the base part. By this means, it is possible to adjust the positions of the seat part and the breast pad part by moving the seat part and the breast pad part forward and backward, and upward and downward, depending on the height of a transfer target such as a bed and a toilet seat, and the physique and the posture of the user to bring the seat part close to the transfer target. Therefore, the user can easily do transfer action alone. In addition, the transfer and locomotion apparatus is applicable in a case where the transfer target has no accommodation space to insert the base part in its lower part. In this way, it is possible to improve versatility.

(5) The drive mechanism part can pivotably rotate the seat part and the breast pad part forward and backward. By this means, the user can safely and easily get on and off the seat part by lowering the seat part and the breast pad part while the seat part and the breast pad part are tilted backward. In addition, it is possible to hold the user in a desired posture (at a desired angle) or lift to a desired level while the seat part and the breast pad part are tilted forward and raised. Moreover, the user can locomote in a comfortable posture, and therefore it is possible to improve usability.

(6) There is no backrest in the seat part, and therefore, the back of the user (the back of the seat part) is exposed to outside; therefore, the user having injured back or lumber, more specifically, a patient having injured spine or lumber spine can easily have examination directly from the back surface (back); it is not necessary to transfer to a bed and so forth, and therefore, it is possible to reduce the burden on the user; and also it is possible to reduce the period of time required for medical examination, and therefore improve convenience in medical examination.

(7) The base part has the driving part, and therefore various users, not only old people and physically-handicapped persons but also physically unimpaired children and adults, can easily use the transfer and locomotion apparatus as substitute for a bicycle, a motorcycle and a wheelchair to locomote indoors and outdoors.

(8) The drive mechanism part can raise the seat part, and therefore the user can locomote (drive) in a posture similar to a standing position; by this means, the user can acquire a wider view than a conventional wheelchair; also the user can easily be viewed by other persons to prevent an accident such as a crash, and therefore it is possible to improve safety; it is possible to avoid from constricting blood flow; the transfer and locomotion apparatus can be used instead of a wheelchair, for long-range locomotion; and in this way, it is possible to improve usability.

(9) The drive mechanism part can lift the seat part and the breast pad part, and tilt the breast pad part forward; therefore, the user can reach for positions for which conventional wheelchairs cannot reach; by this means, the user can easily take goods in and out from a high place, open and close a door, wash the face and do cooking; and, in this way, it is possible to expand the user's activities, and therefore improve functionality.

(10) The drive mechanism raises and lowers the seat part to allow the user to exercise his/her hip joints, knee joints, ankle joints and so forth; therefore, the user can do rehabilitation by bending forward him/herself to expand the region in which joints of the lower body can move, build up muscles and improve blood flow; and by this means, it is possible to prevent decrease in motor ability of the lower body, edema and so forth. In this way, it is possible to improve functionality and save labor.

(11) The drive mechanism part has the first and second coupling pivot shafts provided in the base part at two front and back positions, and the third and fourth coupling pivot shafts provided below the seat part at two front and back positions; the first and third coupling pivot shafts are connected via the front link part having one or more link shafts, and the second and fourth coupling pivot shafts are connected via the back link part having one or more link shafts. By expanding and contracting the link driving part having both ends pivotably coupled with the front link part and the back link part, the angle between the upper surface of the base part and the front and back link parts varies while the distance between the first and second coupling pivot shafts and the distance between the third and fourth coupling pivot shafts are fixed, and it is possible to move the seat part placed above the third and fourth coupling pivot shafts upward and downward, pivotably rotating forward and backward. By this means, as compared to a case where the seat part is raised and lowered directly by a direct acting hydraulic or gas-pressure cylinder, it is possible to adjust the height of the seat part in a wider range with a smaller stroke, and therefore reduce the size and the weight of the drive mechanism part.

(12) The seat part is supported on the two front and back positions by the front link part and the back link part. By this means, it is possible to reliably sustain the user's weight and deaden the vibrations during locomotion to improve the stability of the posture.

(13) The seat part and the breast pad part are slidably provided on the strut standing on the third coupling pivot shaft. Therefore, it is possible to move the seat part and the breast pad part upward and downward, depending on the physique and so forth of the user to broaden the range in which the seat part and the breast pad part can move. In this way, it is possible to improve versatility.

(14) The grippers that pivotably rotate in a horizontal plane are provided in at least one side of the breast pad part. By this means, the user can grip the grippers with his/her hands to approach or get away from the transfer and locomotion apparatus. Therefore, it is possible to easily adjust the position of the transfer and locomotion apparatus, and consequently improve usability.

(15) When the seat part and the breast pad part are moved, the user can reliably hold his/her body by gripping the grippers, and therefore it is possible to improve safety.

(16) The grippers can pivotably rotate in the horizontal plane. Therefore, the grippers are pivotably rotated forward after the user gets on the transfer and locomotion apparatus. By this means, it is possible to prevent the grippers from restraining the posture of the user. In addition, the breast pad part can reliably sustain the user's weight in a forward bending posture, and therefore it is possible to improve the stability and reliability of support.

(17) The grippers can be moved to the optimum positions for respective actions in transfer and locomotion only by pivotably rotating the grippers, and therefore improve versatility. In addition, it is possible to reduce the number of parts, and therefore improve mass productivity.

(18) The leg protecting part is provided in the front portion of the base part to hold at least part of the legs of the user. By this means, it is possible to sustain the user's weight by sharing the weight among the breast pad part, the seat part and the leg protecting part. In particular, it is possible to stably maintain the posture of the user even if the user is in an approximately standing posture, and therefore improve usability.

(19) The leg protecting part provided in the front portion of the base part can protect the knees, shins, and calves, and therefore it is possible to improve safety.

(20) The auxiliary frames with casters are provided in both sides of the base part to be able to move forward and backward parallel to the longitudinal direction of the base part. The auxiliary frames are moved forward and backward according to the posture (the position of the center of gravity) of the user. By this means, it is possible to keep balance to prevent the base part from falling down, and therefore improve safety.

(21) When the transfer and locomotion apparatus is not used, the auxiliary frames with casters are moved to overlap both sides of the base part. By this means, it is possible to reduce the overall length of the transfer and locomotion apparatus to be stored in a small space, and therefore improve portability and save space.

Embodiment 2

Figure 9:
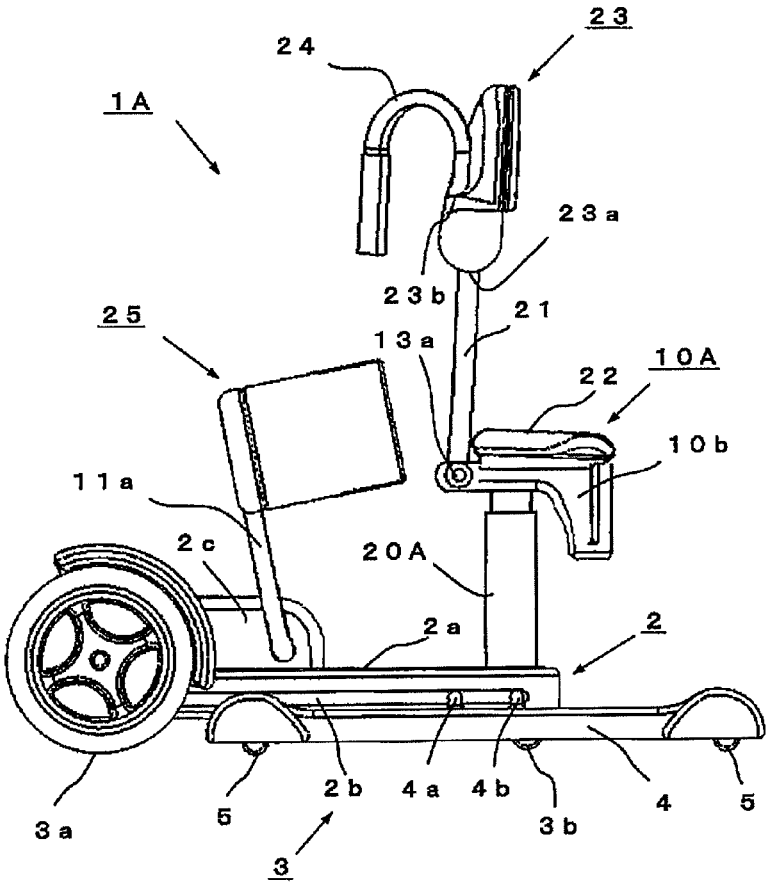
FIG. 9 is a side view schematically showing a state in which the seat part of the transfer and locomotion apparatus according to Embodiment 2 is lowered.

FIG. 9 is a side view schematically showing a state where the seat part of the transfer and locomotion apparatus according to Embodiment 2 is lowered.

In FIG. 9, a transfer and locomotion apparatus 1A according to Embodiment 2 is different from the transfer and locomotion apparatus 1 according to Embodiment 1 in that a drive mechanism part 10A is employed to move the seat part 22 and the breast pad part 23 upward and downward using a piston cylinder 20A, which may be a hydraulic or gas-pressure cylinder, instead of the drive mechanism part 10 using the four-link mechanism to allow the seat part 22 and the breast pad part 23 to pivotably rotate and move upward and downward; in that the pivot shaft holding part 10*b* is integrally formed with the lower portion of the seat part 22; and in that the strut 21 is pivotably held by the pivot shaft holding part 10*b* via the coupling pivot shaft 13*a*.

Although, with the present embodiment, the piston cylinder 20A is employed in the drive mechanism part 10A, the present invention is not limited to this. Elevating means such as a combination of a rack and a pinion, a link mechanism of a lazy tong, and a ball screw and so forth may be used. Moreover, the seat part 22 and breast pad part 23 may be manually tilted and fixed with a ratcheting mechanism or screw cramp.

Moreover, the drive mechanism part 10A may not necessarily move the seat part 22 and the breast pad part 23 upward and downward in the vertical direction. Another configuration is possible where the drive mechanism part 10A moves the seat part 22 and the breast pad part 23 diagonally from a back and lower position to a front and upper position with respect to the base part 2 to move the seat part 22 and the breast pad part 23 forward and backward, and upward and downward at the same time. In this case, the user can readily move the seat part 22 to the optimum position for transfer, getting on and off, and locomotion (driving) in a single action, and therefore it is possible to save labor and improve usability. In addition, when the seat part 22 is moved between a back and lower position and a front and upper position with respect to the base part 2, it is possible to sustain the user's weight by applying the weight to the breast pad part 23 provided in front of the user. By this means, it is possible to move the seat part 22 forward and backward, and upward and downward safely without losing the balance. Also, it is possible to prevent the user from falling off the seat part or falling down, so that everyone can easily use the transfer and locomotion apparatus, feeling relieved. In this way, it is possible to improve the stability and reliability of operation.

Here, how to use the transfer and locomotion apparatus 1A according to Embodiment 2 is the same as for the transfer and locomotion apparatus 1 according to Embodiment 1, so that descriptions will be omitted.

The transfer and locomotion apparatus according to Embodiment 2 has the above-described configuration. By this means, it is possible to produce the following effects, in addition to the effects of (1) to (3), (6) to (8), and (14) to (21) obtained with Embodiment 1.

(1) The drive mechanism part is provided to move the seat part and the breast pad part upward and downward direction of the base part. By this means, it is possible to freely adjust the positions of the seat part and the breast pad part, depending on the height of a transfer target such as a bed and a toilet seat, and the physique and the posture of the user. Also it is possible to bring the seat part close to the transfer target, and therefore the user can easily do transfer action alone. In addition, even if there is no space in the lower part of the transfer target to accommodate the base part, the transfer and locomotion apparatus can be used. In this way, it is possible to improve versatility.

(2) The drive mechanism part can move the seat part and the breast pad part upward and downward. Therefore, after the seat part and the breast pad part are lowered and the user gets on the seat part, the seat part and breast pad part are raised, so that the user can be lifted to a desired level. By this means, the user can locomote in a comfortable posture, and therefore it is possible to improve usability.

(3) The drive mechanism part can raise the seat part and the breast pad part, and therefore the user can reach for positions for which conventional wheelchairs cannot reach. By this means, the user can easily take goods in and out from a high place, open and close a door, wash the face and do cooking. In this way, it is possible to expand the user's activities and improve functionality.

(4) The seat part can be moved upward and downward easily and reliably only by the piston cylinder. Therefore, it is possible to easily adjust the height of the seat part to the height of the transfer target such as a bed and a toilet seat. In this way, it is possible to improve usability.

(5) The seat part moves only upward and downward by the piston cylinder, so that the center of gravity does not significantly change forward and backward. This eliminates balance adjustment using the auxiliary frames with casters, and therefore it is possible to improve usability.

(6) By using the piston cylinder, it is possible to reduce the number of parts and simplify the configuration of the drive mechanism part. By this means, it is possible to reduce the size and the weight of the transfer and locomotion apparatus, and therefore improve mass productivity and ease maintenance.

(7) The breast pad part is tilted forward to apply the user's weight to the breast pad part. By this means, in particular, it is possible to significantly reduce the strain on the user who has injured-spine, and sit in a comfortable posture for a long period of time. In this way, it is possible to improve usability and versatility.

Embodiment 3

Figure 10:
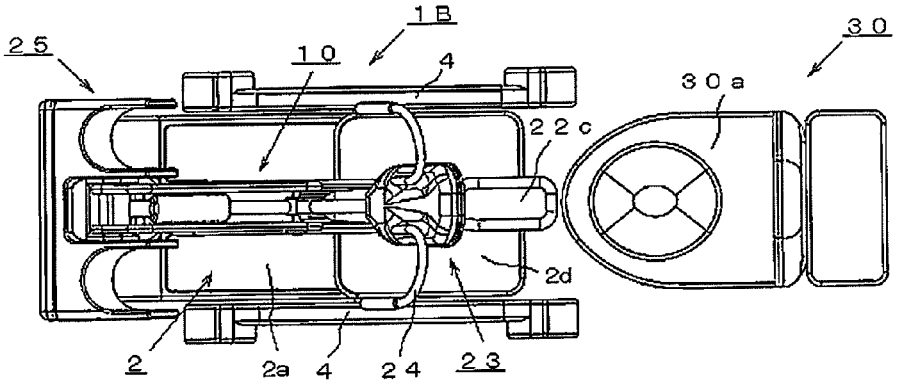
FIG. 10 is a plan view schematically showing a state in which the seat part of the transfer and locomotion apparatus according to Embodiment 3 is lowered.
Figure 11:
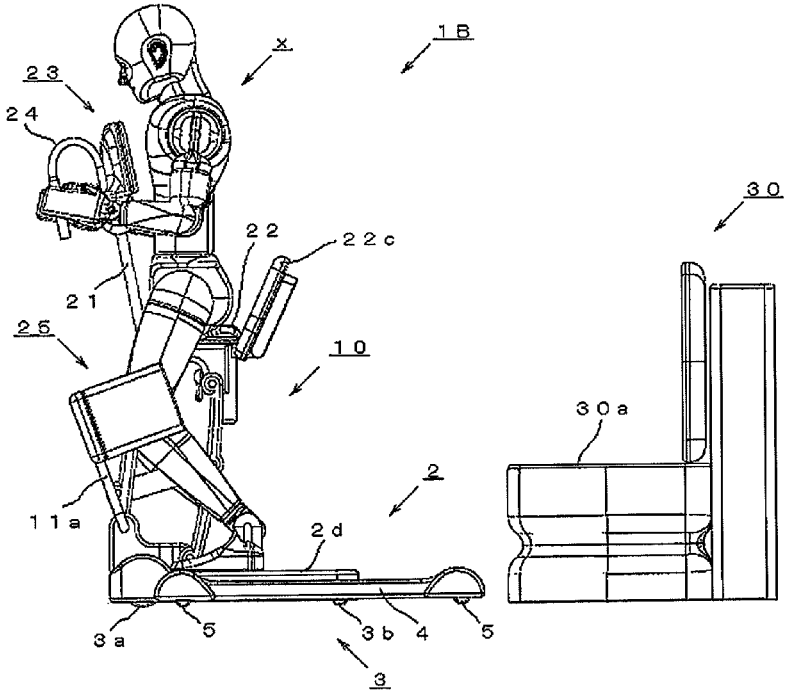
FIG. 11 is a side view schematically showing a state in which the user gets on the transfer and locomotion apparatus according to Embodiment 3 in a standing posture.
Figure 12:
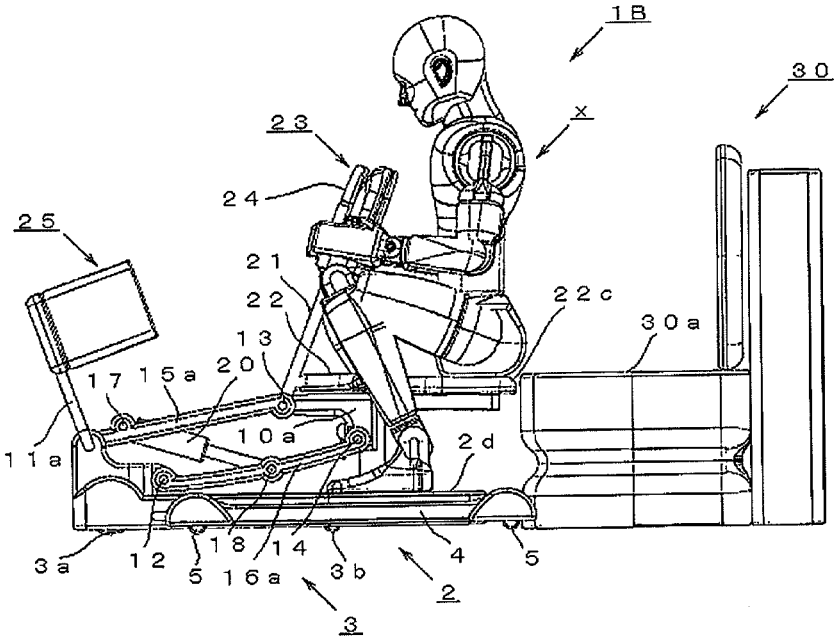
FIG. 12 is a side view schematically showing a state before the user transfers to a toilet seat using the transfer and locomotion apparatus according to Embodiment 3.

FIG. 10 is a plan view schematically showing a state where the seat part of the transfer and locomotion apparatus according to Embodiment 3 is lowered. FIG. 11 is a side view schematically showing a state where the user rides on the transfer and locomotion apparatus according to Embodiment 3 in a standing posture. FIG. 12 is a side view schematically showing a state before the user transfers to a toilet seat using the transfer and locomotion apparatus according to Embodiment 3.

Through FIG. 10 to FIG. 12, a transfer and locomotion apparatus 1B according to Embodiment 3 is different from the transfer and locomotion apparatus 1 according to Embodiment 1 in that a driving wheel 3*a* of the driving part 3 is smaller; in that a footrest part 2*d* is provided on the upper surface 2*a* of the base part 2 to slidably move forward and backward; and in that a waist pad part 22*c* is provided, which is pivotably held in the rear end portion of the seat part 22.

In FIG. 10, the footrest part 2*d* is placed on the upper surface 2*a* of the base part 2 and guided along the left and right side portions to slidably move forward and backward. By providing wheels or rollers on the bottom surface or both side portions of the footrest part 2*d*, it is possible to slidably move the footrest part 2*d* smoothly. Here, the footrest part 2*d* can move conjunction with the forward and backward movement of the user x only by placing the user X's feet on the footrest part 2*d* to apply the user's weight to the footrest part 2*d*. More preferably, the footrest part 2*d* may move forward and backward in conjunction with the seat part 22. By this means, it is possible to improve the stability and usability of operation. In order to move the footrest part 2*d* in conjunction with the seat part 22, the motor to drive the wheels of the footrest part 2*d* may be rotated in the forward and reverse directions in conjunction with the expansion and contraction of the link driving part 20 of the drive mechanism part 10. Although, with the present embodiment, the footrest part 2*d* is placed horizontally, another configuration is possible where the footrest part 2*d* is tilted to lower the back portion. In this configuration, the footrest part 2*d* is lowered when the user moves backward, and therefore the user can easily get in and off the transfer and locomotion apparatus. In this way, it is possible to improve usability. In addition, when the footrest part 2*d* moves upward and downward in conjunction with the seat part 22, it is possible to keep the distance between the seat part 22 and the footrest part 2*d* constant and consistently support the feet of the user x on the footrest part 2*d* independent of the height of the seat part 22. By this means, it is possible to improve safety and usability.

In addition, in FIG. 10, the bottom end of the waist pad part 22*c* is pivotably held by the rear end of the seat part 22. By this means, the waist pad part 22*c* pivotably rotates around the horizontal axis orthogonal to the forward and backward direction of the base part 2. Therefore, it is possible to pivotably rotate the waist pad part 22*c* with a desired angle with respect to the seat part 22.

When the user locomotes in a standing posture, the seat part 22 is moved forward and upward and the waist pad part 22*c* stands in the vertical direction as shown in FIG. 11. By this means, the waist pad part 22*c* can safely support around the buttocks of the user x, and therefore it is possible to improve safety.

Next, when the user transfers to the transfer target such as the toilet seat 30*a*, the seat part 22 is moved backward and downward, and also the footrest part 2*d* is moved backward as shown in FIG. 12. By this means, the user x can smoothly move the whole body without losing the balance. Moreover, the waist pad part 22*c* is reclined in the horizontal direction (backward), so that the waist pad part 22*c* does not restrain the movement of the user. By this means, the user can smoothly do transfer action. In this way, it is possible to improve usability. In particular, as shown in FIG. 12, when it is not possible to satisfactorily bring the seat part 22 close to the toilet seat 30*a*, which is a transfer target, the waist pad part 22*c* may be reclined backward. By this means, it is possible to clear the gap between the seat part 22 and the toilet seat 30*a* to smoothly do transfer action between the seat part 22 and the toilet seat 30*a*. In this way, it is possible to improve usability and versatility. In addition, in a case where a step is formed between the seat part 22 and the transfer target because it is not possible to adjust the height of the seat part 22 to that of the transfer target, the waist pad part 22*c* can clear the step.

Although rotating operation of the waist pad part 22*c* may be performed electrically or manually, it is preferable to electrically perform rotating operation because it is possible to pivotably rotate the waist pad part 22*c* with a desired angle with simple operation. By this means, it is possible to improve operationality and save labor. In particular, when the waist pad part 22*c* pivotably rotates automatically in conjunction with the forward and backward movement, and the upward and downward movement of the seat part 22, it is possible to eliminate troublesome operation and prevent the transfer and locomotion apparatus from starting while the waist pad part 22*c* is reclined backward. By this means, it is possible to improve safety and user-friendliness.

Here, when the user locomotes (drives) in a sitting posture, the waist pad part 22*c* may stand to safely support the user x at the time of start or acceleration. By this means, it is possible to improve reliability.

The transfer and locomotion apparatus according to Embodiment 3 has the above-described configuration, and therefore, can provide the following effects, in addition to the effect provided with Embodiment 1.

(1) The waist pad part is provided, which is pivotably held in the rear end side of the seat part. By this means, when the user gets on and off (transfer to/from) the seat part, the waist pad part is reclined in the horizontal direction to prevent the waist pad part from restraining the movement of the user. Meanwhile, when the user sits on the seat part and locomotes, the waist pad part stands in the vertical direction to support the buttocks and the lumbar part of the user, and therefore it is possible to reliably prevent the user from falling off the seat part at the time of start or acceleration. In this way, it is possible to improve usability and safety.

(2) When the seat part is moved backward and downward to transfer the user to a transfer target such as a bed and a toilet seat, a gap may be created between the seat part and the transfer target because it is not possible to satisfactorily bring the seat part close to the transfer target, or a step may be created between the seat part and the transfer target because it is not possible to adjust the height of the seat part to that of the transfer target. To solve these problems, the waist pad part is reclined backward to clear the gap and step. By this means, it is possible to accomplish smooth transfer action of the user between the seat part and a transfer target, and therefore improve usability and versatility.

(3) The footrest part is provided on the base part to slidably move forward and backward. By this means, when the seat part is moved forward and backward, the user can move the whole body forward and backward while placing the feet on the footrest part. Therefore, the user does not need to lift the feet and move the feet forward and backward him/herself. In this way, it is possible to improve the stability of the center of gravity, and also improve usability.

(4) When the seat part is moved backward to transfer the user to a transfer target such as a bed and a toilet seat, it is possible to bring the footrest part close to the transfer target. By this means, it is possible to accomplish transfer action by smoothly shifting the weight, and therefore improve usability.

INDUSTRIAL APPLICABILITY

The present invention provides a transfer and locomotion apparatus with improved functionality, stability, versatility and user-friendliness. The transfer and locomotion apparatus according to the present invention can provide the following effects: the user can easily transfer between the transfer and locomotion apparatus to a bed, a toilet seat, and a wheelchair, keeping the orientation of the body; it is possible to provide a simple structure and the user can be use the transfer and locomotion apparatus alone; it is possible to use the transfer and locomotion apparatus for a long period of time without applying the strain on the back and the lumbar part of the user; in particular, even if the user has injured-spine and so forth, it is possible to use the transfer and locomotion apparatus comfortably; it is possible to significantly reduce the burdens on the caretaker and the user; and not only old people and physically-handicapped persons, but also physically unimpaired children and adults can easily use the transfer and locomotion apparatus as substitute for a bicycle, a motorcycle, a wheelchair and so forth to locomote for a long distance. In addition, one transfer and locomotion apparatus can be used for various purposes such as for transfer and locomotion, and rehabilitation, and therefore reduce the burdens on not only the user but also caretakers and physicians.

REFERENCE SIGNS LIST

1, 1A, 1B transfer and locomotion apparatus
2 base part
2*a* upper surface
2*b* guide slit
2*c* pivot shaft holding plate
2*d* footrest part
3 driving part
3*a* driving wheel
3*b* rear wheel
4 auxiliary frames with casters
4*a*, 4*b* coupling shaft
5 caster
10, 10A drive mechanism part
10*a*, 10*b* pivot shaft holding part
11 first coupling pivot shaft
11*a* bending part
12 second coupling pivot shaft
13 third coupling pivot shaft
13*a* coupling pivot shaft
14 fourth coupling pivot shaft
15 front link part
15*a*, 15*b*, 16*a*, 16*b* link shaft
16 back link part
17 front coupling shaft
18 back coupling shaft
20 link driving part
20A piston cylinder
21 strut
22 seat part
22*a* insert part
22*b* fixing operation part
22*c* waist pad part
23 breast pad part
23*a* insert hole
23*b* engaging hole
24 gripper
25 leg protecting part
25*a* knee pad part
30 toilet
30*a* toilet seat
x user

The invention claimed is:

1. A transfer and locomotion apparatus to which a user transfers alone to locomote indoors and outdoors by using the apparatus, the apparatus comprising:

a base part having a driving part;

a seat part provided on the base part, held to be able to move forward and backward, and upward and downward, with respect to the base part, having a back portion of the seat part opened at the time of transfer, wherein a user can sit on the seat part from the back portion of the base part;

a breast pad part directly standing at a front end of the seat part, integrally formed with the seat part and for contacting a breast of the user; and at least one drive mechanism part common to the seat part and the breast pad part, the drive mechanism part being coupled to the seat part and configured to move the seat part together with the breast pad part forward and backward, and upward and downward so as to move them between a back and lower position with respect to the base part and a front and upper position with respect to the base part.

2. The transfer and locomotion apparatus according to claim 1, wherein the drive mechanism part moves the seat part together with the breast pad part forward and backward, and upward and downward by using a piston cylinder or a ball screw.

3. The transfer and locomotion apparatus according to claim 1, wherein the drive mechanism part pivotably rotates the seat part together with the breast pad part around a horizontal axis orthogonal to a forward and backward direction of the base part to move the seat part together with the breast pad part forward and backward, and upward and downward.

4. The transfer and locomotion apparatus according to claim 3, wherein a four-link mechanism, which pivotably rotates the seat part together with the breast pad part to move them forward and backward, and upward and downward, is used as the drive mechanism part.

5. The transfer and locomotion apparatus according to claim 4, wherein the four-link mechanism of the drive mechanism part comprises:

a first coupling pivot shaft and a second coupling pivot shaft provided in the base part, the first shaft being in a front portion and the second shaft being in a back portion;

a third coupling pivot shaft and a fourth coupling pivot shaft provided below the seat part, the third shaft being in a front portion and the fourth shaft being in a back portion;

a front link part having one or more link shafts configured to connect between the first coupling pivot shaft and the third coupling pivot shaft;

a back link part having one or more link shafts configured to connect between the second coupling pivot shaft and the fourth coupling pivot shaft; and a link driving part configured to expand and contract, the link driving part having both ends pivotably coupled to the front link part and the back link part, respectively, and at least one of the seat part and the breast pad part is slidably provided on a strut, the strut standing on one of the third coupling pivot shaft and a pivot shaft holding part configured to pivotably hold the third coupling pivot shaft and the fourth coupling pivot shaft.

6. The transfer and locomotion apparatus according to claim 1, further comprising a waist pad part configured to stand in the vertical direction to support buttocks or a lumbar part of the user when the user sits on the seat part and locomotes.

* * * * *